United States Patent [19]

Hegarty

[11] Patent Number: 4,925,146

[45] **Date of Patent: * May 15, 1990**

[54] MULTI-POSITIONABLE DOCUMENT SUPPORT STAND AND INTERLOCKING MODULAR DOCUMENT HOLDER

[76] Inventor: David Hegarty, 36 Wyatt Rd., Garden City, N.Y. 11530

[ * ] Notice: The portion of the term of this patent subsequent to Nov. 29, 2005 has been disclaimed.

[21] Appl. No.: 273,404

[22] Filed: Nov. 18, 1988

Related U.S. Application Data

[63] Continuation-in-part of Ser. No. 45,630, May 1, 1987, Pat. No. 4,787,595, which is a continuation-in-part of Ser. No. 791,743, Oct. 28, 1985, abandoned.

[51] Int. Cl.[5] ..... A47G 1/24

[52] U.S. Cl. ..... 248/454; 248/447; 248/458

[58] Field of Search ..... 248/454, 455, 456, 450, 248/451, 452, 453, 447, 447.2, 295.1, 296, 298; 402/70, 75, 73; 403/381, 375, 354, 331; 281/47, 48

[56] References Cited

U.S. PATENT DOCUMENTS

| | | | |
|---|---|---|---|
| 165,500 | 7/1875 | Patton . | |
| 598,689 | 2/1898 | Wilson . | |
| 2,003,746 | 6/1935 | Hedington | 248/456 X |
| 2,165,255 | 7/1939 | Hamilton . | |
| 2,323,123 | 6/1943 | Donato et al. | 281/47 |
| 2,325,155 | 7/1943 | Wedge | 402/75 |
| 2,459,873 | 1/1949 | Curtis . | |
| 2,502,275 | 3/1950 | Perlin | 402/75 X |
| 2,562,518 | 7/1951 | Abrams | 281/19 R X |
| 2,568,131 | 9/1951 | Segal | 402/70 |
| 2,620,801 | 12/1952 | Panfil, Sr. | 402/75 |
| 2,721,417 | 10/1955 | Dickinson | 248/453 |
| 3,043,047 | 7/1962 | Le Fleur | 248/454 |
| 3,095,665 | 7/1963 | Killen | 248/452 X |
| 3,233,611 | 2/1966 | Stewart et al. . | |
| 3,366,359 | 1/1968 | Wolf et al. | 248/447 |
| 3,408,032 | 10/1968 | Francis . | |
| 3,425,421 | 2/1969 | Feder | 281/48 |
| 3,926,398 | 12/1975 | Vincent . | |
| 4,009,599 | 3/1977 | Patriquin | 70/90 |
| 4,066,168 | 1/1978 | O'Toole et al. . | |
| 4,116,413 | 9/1978 | Andersen | 248/455 X |
| 4,179,091 | 12/1979 | Bidney | 248/295.1 X |
| 4,341,166 | 7/1982 | Cantley | 70/85 X |
| 4,389,133 | 6/1983 | Oberst . | |
| 4,444,418 | 4/1984 | Goldstein | 402/75 X |
| 4,462,317 | 7/1984 | Franko et al. | 70/63 X |
| 4,475,365 | 10/1984 | Swisher . | |
| 4,508,306 | 4/1985 | Kemmerer, Jr. . | |
| 4,564,732 | 1/1986 | Lancaster et al. | 403/381 X |
| 4,568,052 | 2/1986 | Solomon et al. | 248/477 X |
| 4,582,442 | 4/1986 | Rager | 402/75 |
| 4,583,877 | 4/1986 | Wilson | 402/75 |
| 4,643,384 | 2/1987 | Guerin | 248/453 X |
| 4,691,541 | 9/1987 | McQuade, Sr. | 70/77 |
| 4,722,627 | 2/1988 | Salacuse | 402/75 X |
| 4,776,552 | 10/1988 | March | 248/455 |
| 4,787,595 | 11/1988 | Hegarty | 248/454 |

FOREIGN PATENT DOCUMENTS 2659819 10/1977 Fed. Rep. of Germany .

*Primary Examiner*—Ramon O. Ramirez
*Attorney, Agent, or Firm*—Hoffmann & Baron

[57] ABSTRACT

A document support stand for removably mounting a document holder on the stand includes a main body which may be formed in the shape of a truncated pyramid. The body has a viewing side, and first and second support sides for supporting the stand on a desk or table top. The support sides constitute adjacent sides on the truncated pyramid body, and are disposed at acute angles to the viewing side. An elongated bracket defining a T-slot is mounted on the viewing side of the body. The document holder includes an elongated member configured as a T-shaped rail which is receivable by the bracket of the stand so that the document holder may be mounted on the stand. The stand may be rotated 90° from one support side to the other so that the viewing side and the document holder mounted on the viewing side may be disposed in different viewing positions.

50 Claims, 14 Drawing Sheets

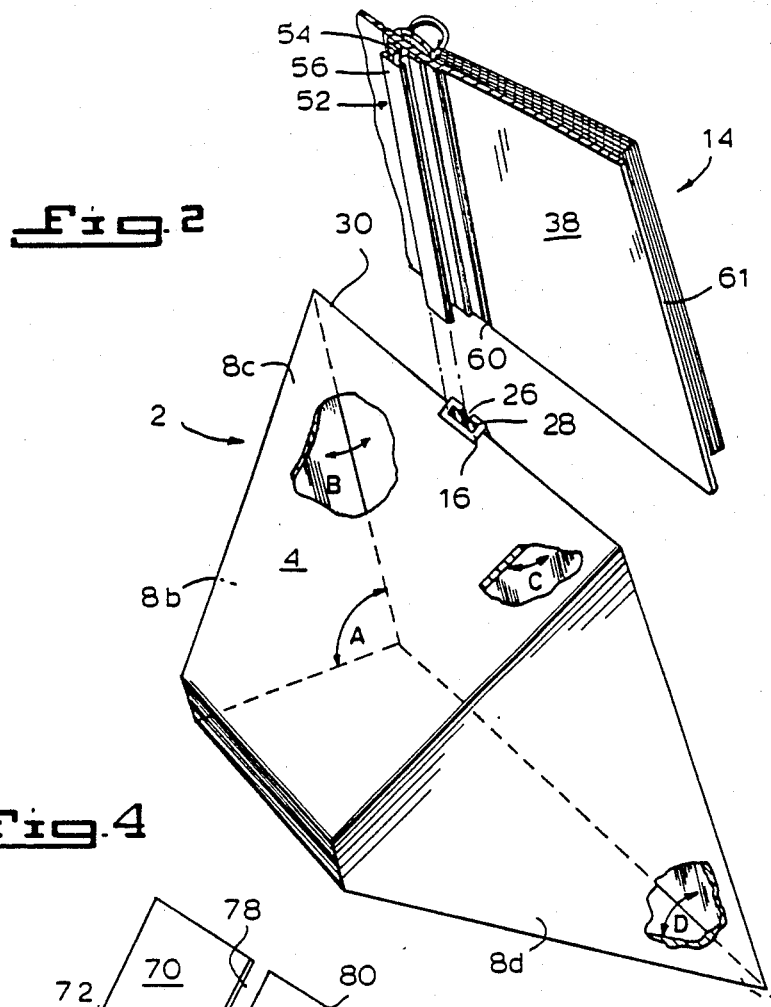
Fig. 2
Fig. 4
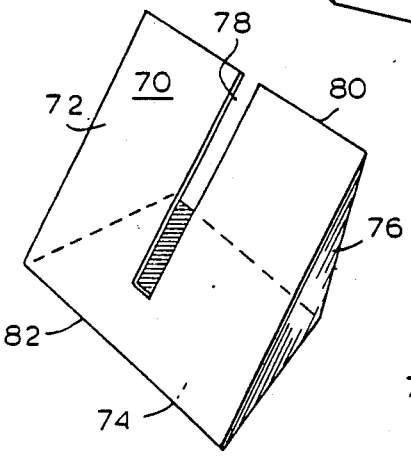
Fig. 4A
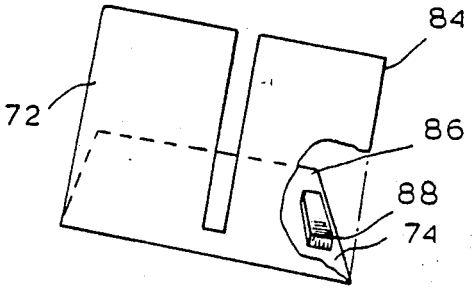

Fig. 11
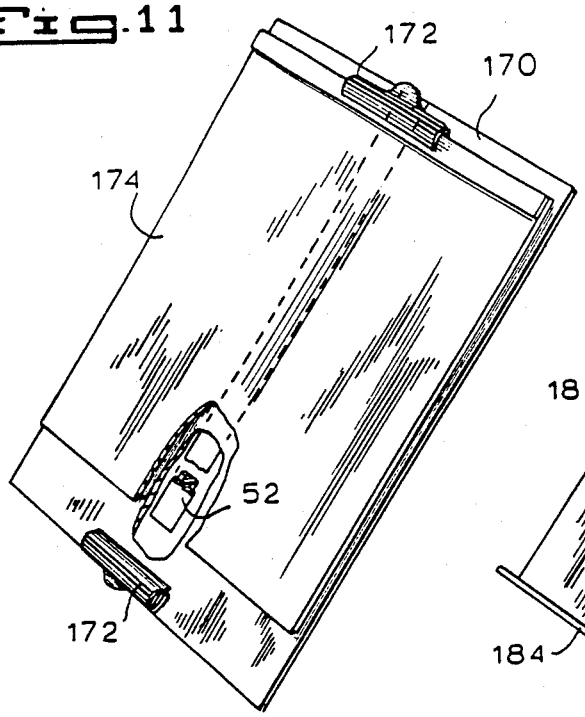
Fig. 13
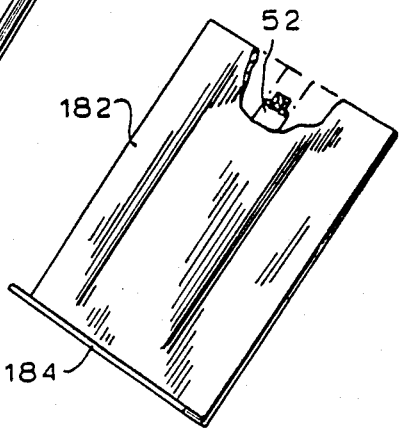
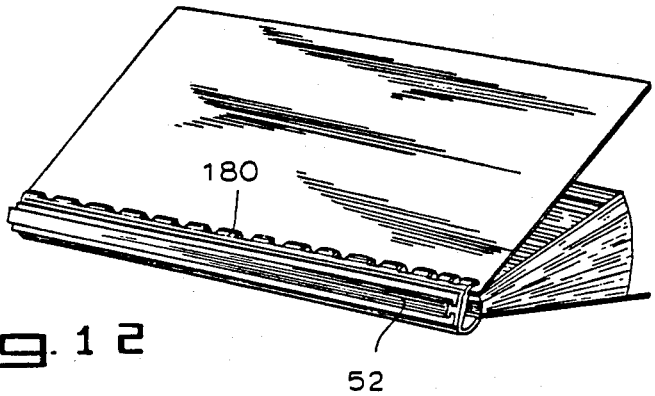
Fig. 12

Fig. 31
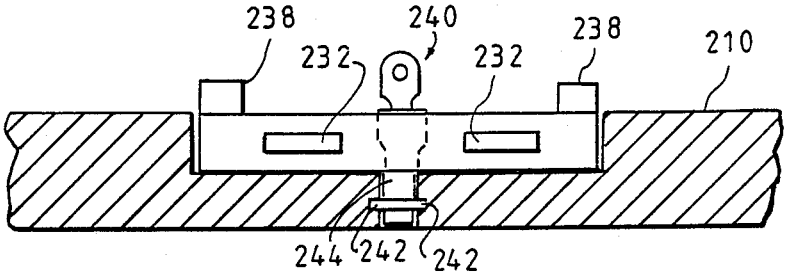
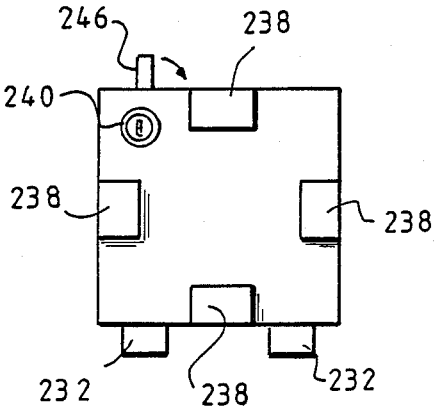
Fig. 32
Fig. 33
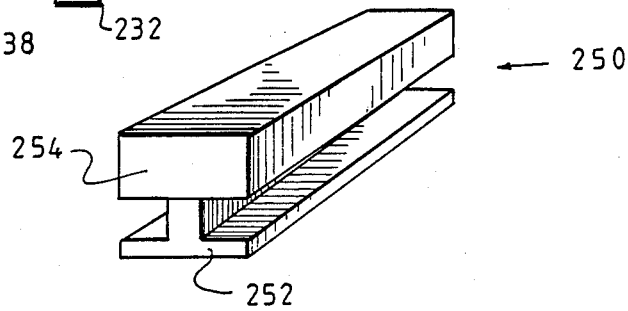
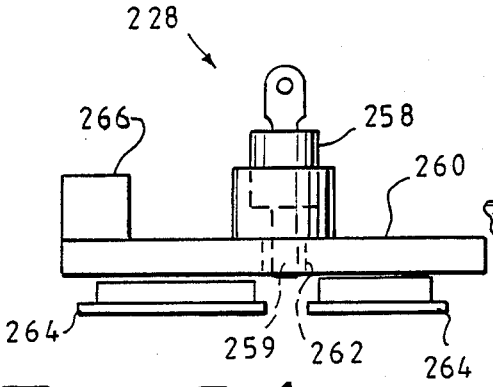
Fig. 34
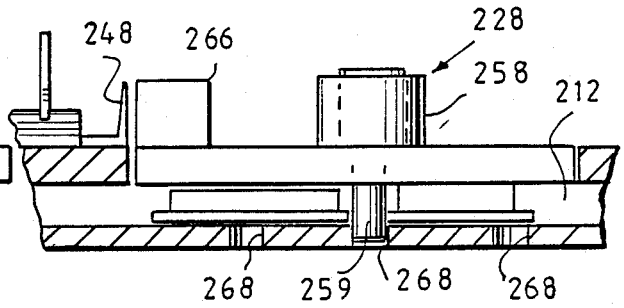
Fig. 35

Fig. 36
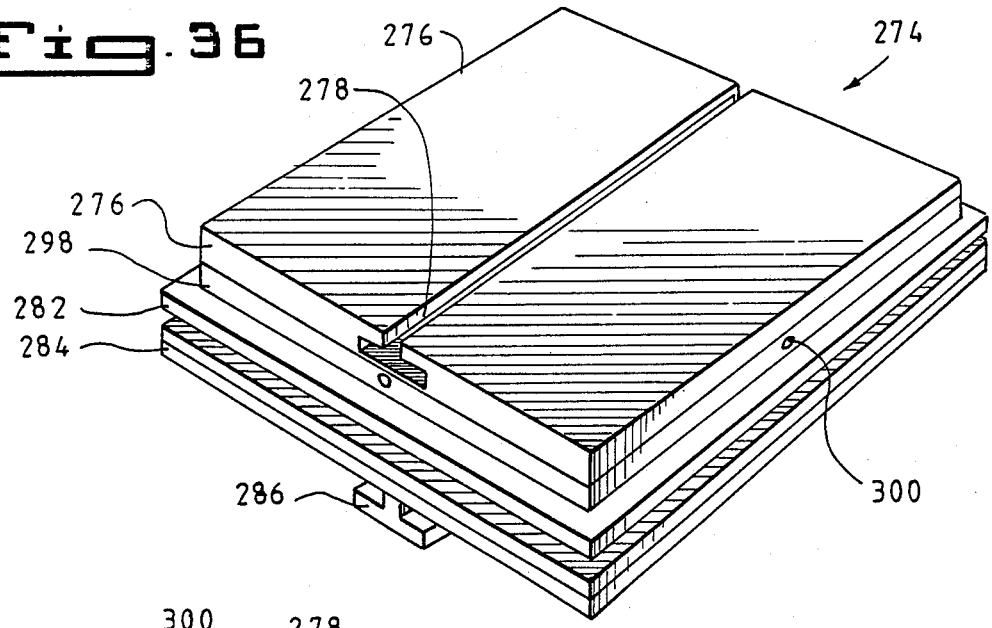
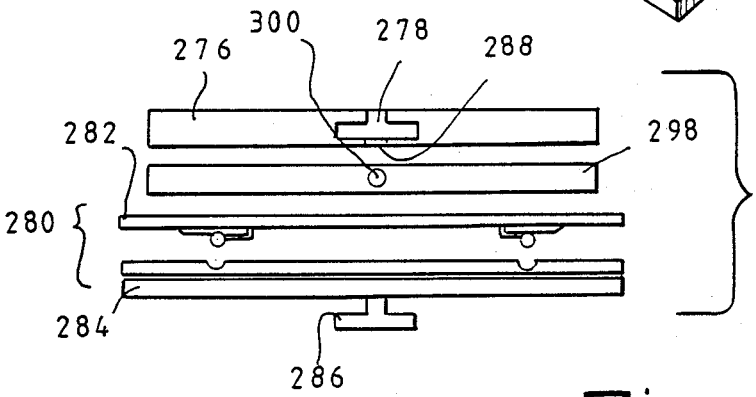
Fig. 37
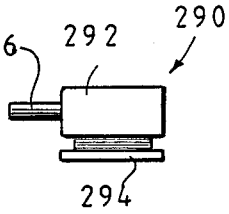
Fig. 38
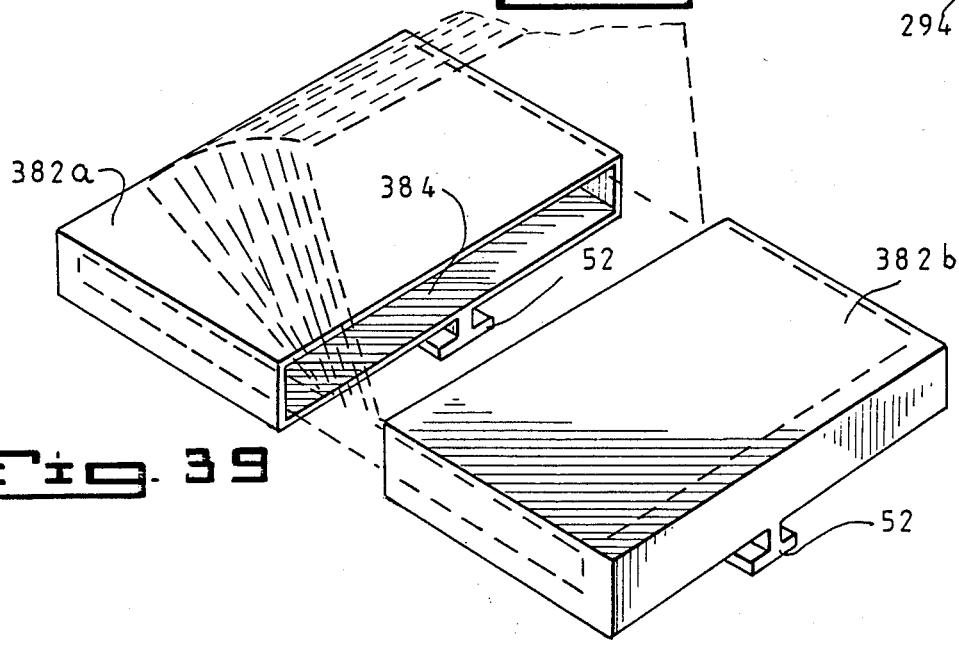
Fig. 39

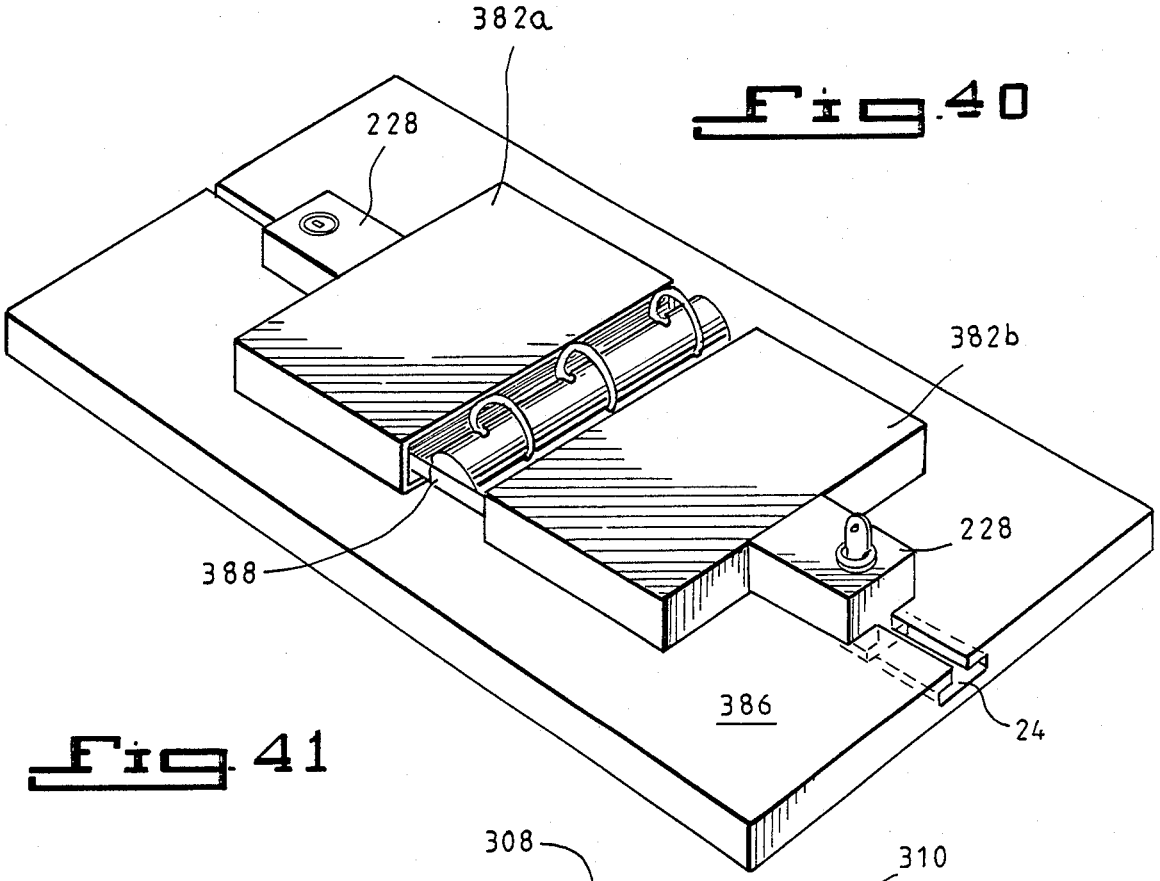
Fig. 40
Fig. 41
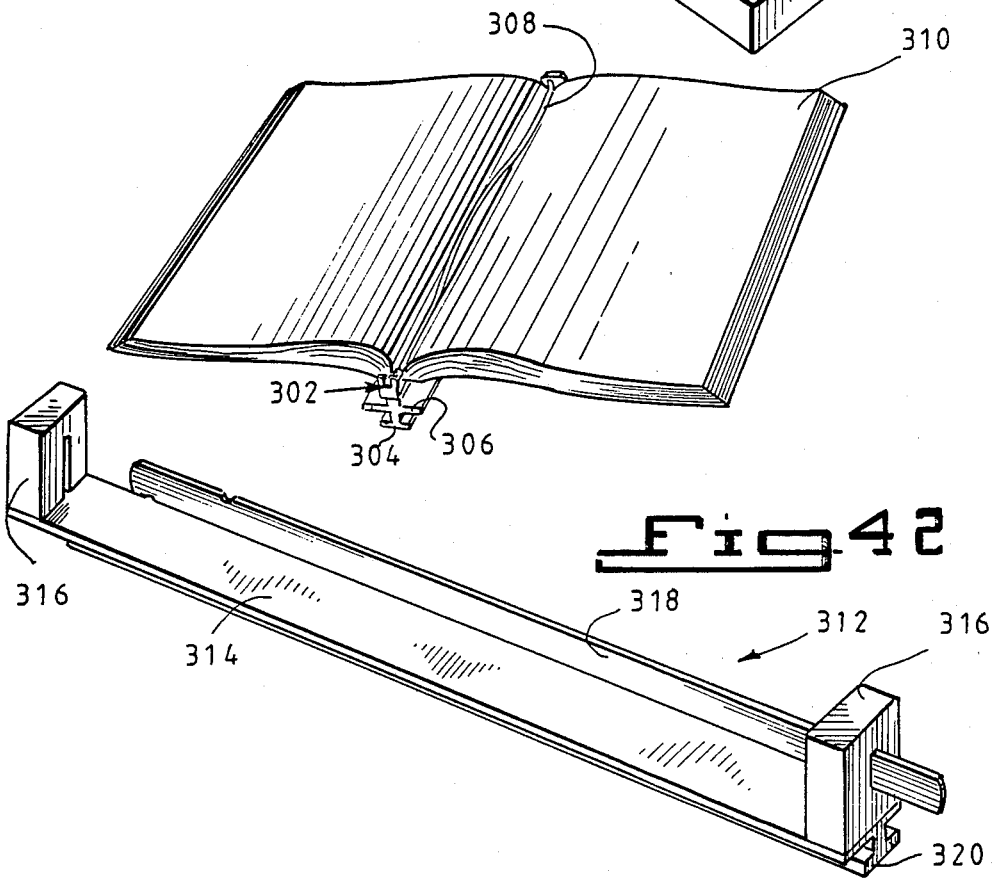
Fig. 42

Fig. 43
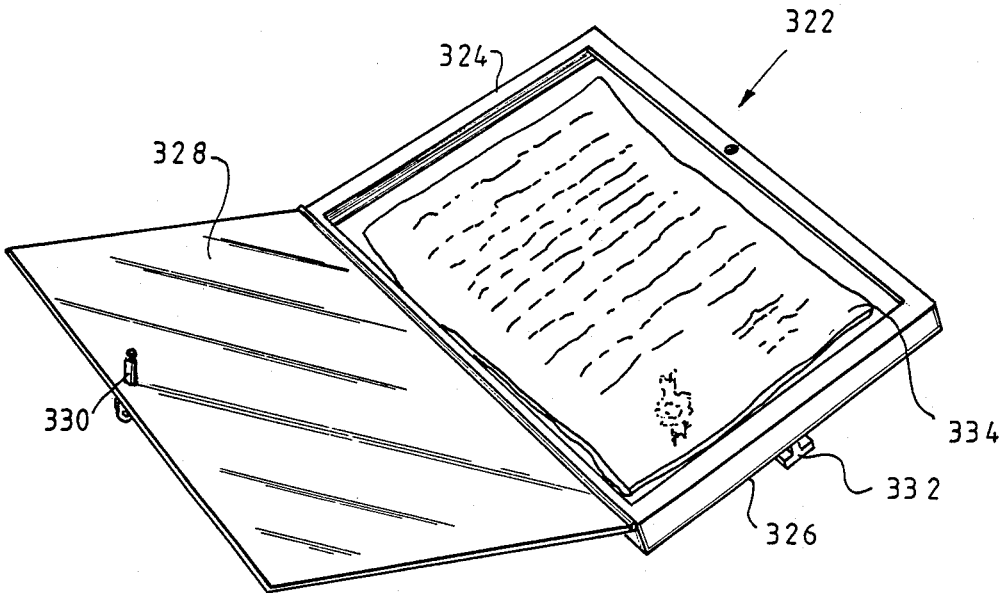
Fig. 44
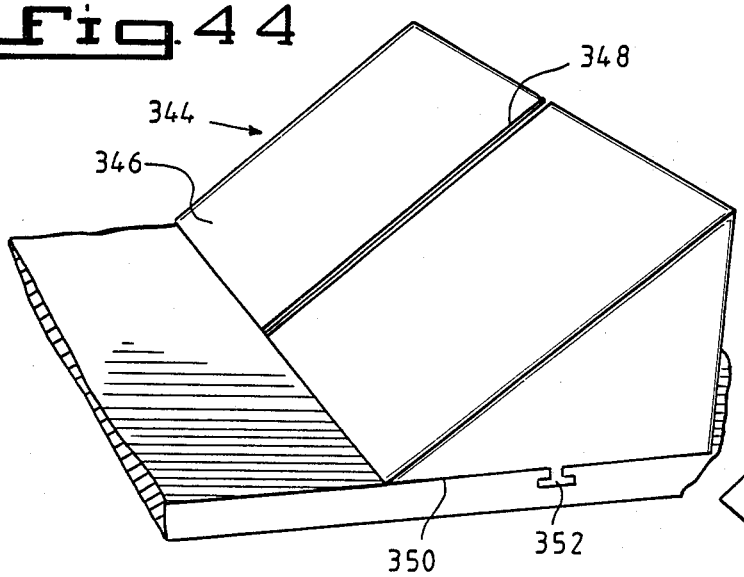
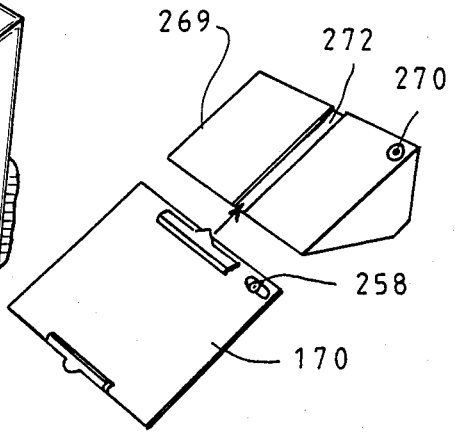
Fig. 45

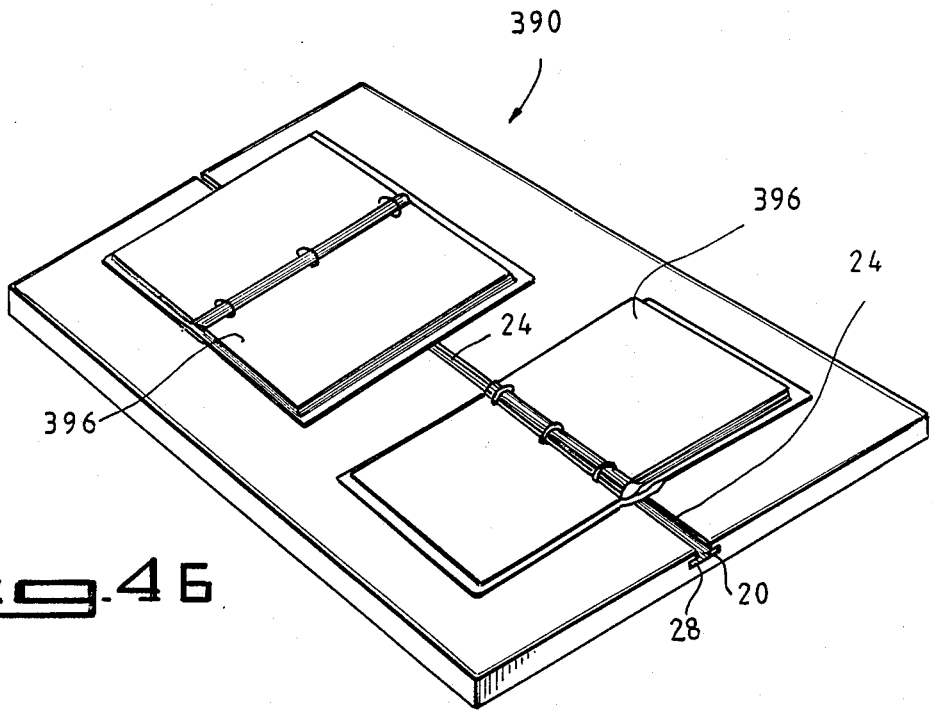
Fig. 46
Fig. 48
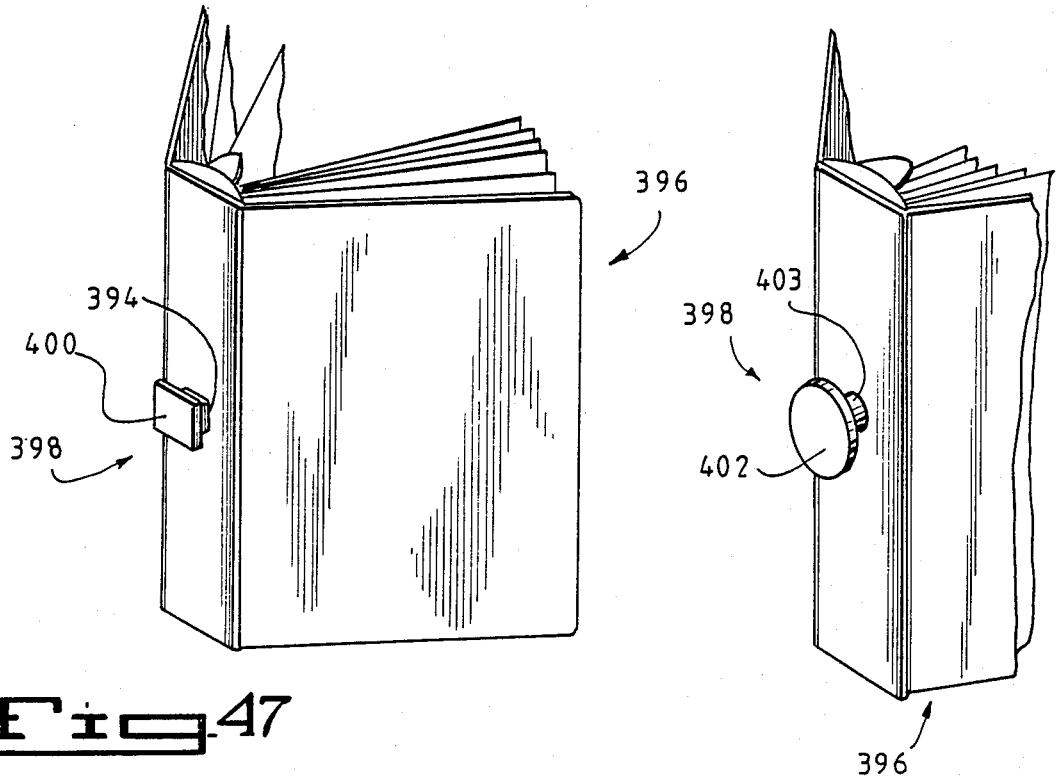
Fig. 47

MULTI-POSITIONABLE DOCUMENT SUPPORT STAND AND INTERLOCKING MODULAR DOCUMENT HOLDER

CROSS-REFERENCE TO RELATED APPLICATION

This application is a continuation-in-part of copending prior application Ser. No. 045,630, filed May 1, 1987, (now U.S. Pat. No. 4,787,595) which is a continuation-in-part of prior application Ser. No. 791,743, filed Oct. 28, 1985, now abandoned.

BACKGROUND OF THE INVENTION

1. Field of the Invention

This invention relates to document support devices, and more particularly relates to a desk top supported or suspended stand for supporting documents in two or more viewing dispositions, and document holders which can be selectively interlocked with the support stand.

2. Description of the Prior Art

The term "document" hereinafter refers to a single page or a multiple number of pages.

The term "document holder" hereinafter refers to that type of device which is adapted to secure a document, such as in the form of a book, spiral bound manual, loose-leaf binder or the like, as well as conventional document stands, such as will be described, which are modified in accordance with the principles of this invention.

Document support stands for supporting a document or document holder are well-known in the art and come in a variety of configurations and structures. Many conventional stands are designed to rest on a desk or table top, and to support the document at a substantial viewing angle to the horizontal.

One of the primary disadvantages of many conventional viewing stands is that they are not adaptable for supporting a document in multiple viewing positions without manipulating the document on the stand.

For example, one conventional type of document support stand is L-shaped and includes an easel back with a bottom support ledge on which the document or document holder rests. This easel type stand is designed primarily to support a book, spiral bound manual, loose-leaf binder or other form of document holder with its spine in a vertical disposition, the edge of the spine being supported by the ledge of the stand. The stand is not designed to support the document holder on the side edge of the holder's back cover with its spine horizontal, nor is the document holder designed to be supported in such a manner, as the document holder supported thusly oftentimes folds uncontrollably at creases formed in its cover, collapses under its weight or generally cannot be maintained upright and open on the stand. As a matter of course, such documents holders, and other types as well, are often simply placed horizontally on the desk top surface causing the operator to have to refocus in different planes and distances when referring back and forth between document and typewriter or video display terminal.

Certain other types of conventional viewing stands include a document securing bar, page retainer or sentence marker which extends across the viewing surface of the stand. Many times the securing bar is suitable to hold a manual or loose-leaf binder against its viewing surface with the spine of the manual or binder in a horizontal disposition, especially if the manual or binder is lightweight and not bulky.

However, changing the reading pattern requires removing the securing bar and manipulating the manual on the stand, and then readjusting the securing bar to support the manual in its new disposition. Furthermore, the securing bar itself may interfere with the material being read, and it may be necessary to constantly readjust the position of the securing bar.

Another type of conventional stand is the clipboard type, having a support back and a clip fastener mounted on the support back. Like other conventional document support stands, manipulation of the document on the stand is required to change the reading pattern. Furthermore, this type of stand is impractical in use because it requires refastening the document each time a page is turned. Also, the clip fastener may be undersized to support a bulky manual.

The problem of having to change the reading pattern is exacerbated in today's society where many of the manuals digested are of a technical nature and include diagrams and charts in columnar form. This is particularly true with present day computer software documentation and training manuals in which text is presented in a standard book format, with pages reading from left to right and computer screen illustrations, flow charts, programs and tables being presented from top to bottom. The reader must constantly adjust his reading pattern by manipulating the manual. This constant need for reorientation by the computer operator trainee is inefficient, confusing and tiring, all of which impairs the learning process.

The further problem with document support stands which are currently available is that they are not adapted to adequately support the newer forms of loose-leaf binders. These binders are often of the type which use a loose-leaf D ring mechanism, with the mechanism being offset from the center spine panel of the cover or jacket and being mounted on the inside back cover of the binder. Offsetting the ring mechanism is advantageous for storing pages uniformly and compactly. However, such offsetting requires the cover or jacket of the binder be made considerably larger than a conventional binder cover. The large cover consumes valuable desk top space, and the binders are cumbersome and poorly supported on the side edges of their cover by conventional viewing stands.

No currently available viewing stand has the ability to rotatably support a binder mechanism of a loose-leaf binder, which mechanism may be removed from the cover or jacket of the loose-leaf binder and directly secured to the viewing stand, without the jacket.

Furthermore, the viewing stands which are currently available have their own supporting mechanism, such as a bracket mounted on the back of the viewing stand to support the stand in a particular angular disposition for viewing documents. No common support mechanism is currently available which is adapted to interfit with and support various types of document support stands so that different stands may be interchanged on the same supporting mechanism. Consequently, many documents are not properly supported for viewing because of the absence of a common document support mechanism.

OBJECTS AND SUMMARY OF THE INVENTION

It is an object of the present invention to provide a document support stand adapted for securing a document holder in multiple viewing positions.

It is another object of the present invention to provide a desk top or suspended multi-positionable document support stand.

It is yet another object of the present invention to provide a support stand and a document holder adapted to be selectively interlocked on the support stand and supported by the stand in multiple positions.

It is a further object of the present invention to provide a support stand and document holder, where the holder includes a mechanism for securing documents, which mechanism may be removed and secured to the support stand.

It is a still further object of the present invention to provide a support stand which is simple in construction and easily manufactured.

It is yet a further object of the present invention to provide a document support stand which secures the document holder to the stand without interfering with the text of the document.

It is still another object of the present invention to provide a document support stand and document holder, each having cooperating interlocking mechanisms for removably mounting the document holder on the support stand.

It is a further object of the present invention to provide a document support stand which overcomes the inherent disadvantages of known support stands.

It is a still further object of the present invention to provide a system of interchangeable document holders and document support devices, each of which includes cooperating interlocking means which allow the free interchange of one holder or support device for another.

It is another object of the present invention to provide a document support stand which will improve the ergonomic environment of individuals referring to visual information.

It is a further object of the present invention to provide a document support stand that will increase the comfort, understanding and productivity of video display terminal operators.

It is yet another object of the present invention to provide a document support stand that will properly support for viewing and interpretation information presented in such visual formats as: instructional and reference manuals, word processing, application, integrated or computer assisted design (CAD) programs, graphs, spreadsheets and the like.

In accordance with one aspect of the present invention, the document support stand includes a main body which may be formed in the shape of a truncated pyramid. The body has a viewing side (which is defined by the base side of the truncated pyramid body), and first and second support sides for supporting the stand on a desk or table top, or other support surface. The support sides are transversely disposed to each other and preferably constitute adjacent sides on the truncated pyramid body. Thus, the body may be rotated 90°. with either its first or second support side resting on the desk or table top, so that the viewing side may be disposed in different positions.

The main body of the stand includes a mounting device for removably mounting a document holder on the body. The mounting device is secured to the viewing side of the main body.

In a preferred form of the invention, the mounting device is an elongated bracket, C-shaped in cross-section, which defines a T-slot having an exposed open end. The bracket is mounted in a recess formed across the surface of the main body's viewing side.

The document support stand may be hollow, and include on its inside a movable weight, such as in the form of a bean bag or the like, which allows the center of gravity of the document support stand to change when the stand is repositioned from one support side to another.

According to the present invention, a document holder, such as a loose-leaf binder, includes a document mounting device (for example, the binder mechanism), a support for the document mounting device (for example, the jacket, including the front and back covers, on which the binder mechanism is mounted), and an elongated member for mounting the document holder on the support stand.

The elongated member in its preferred form is T-shaped in cross-section and, in the example above of a loose-leaf binder-type document holder, is mounted on the spine of the binder's jacket. The T-shaped member of the holder is slidably received by the C-bracket of the stand through the C-bracket's exposed open end, so that the document holder may be secured to the viewing side of the stand's main body.

Positioned thusly on the stand, the document holder and its documents may be disposed in different positions, for viewing the documents from left to right or top to bottom, by simply rotating the stand 90 so that the stand rests on either of its support sides.

A latching mechanism in the form of a cooperating wedge protrusion and conforming recess mounted on the elongated T-shaped member of the document holder and formed in the C-bracket of the stand, respectively, or vice versa, may be included to ensure that the document holder remains secured to the stand until intentionally removed.

These and other objects, features and advantages of this invention will be apparent from the following detailed description of illustrative embodiments thereof, which is to be read in connection with the accompanying drawings.

BRIEF DESCRIPTION OF THE DRAWINGS

FIG. 2 is a rear perspective view of the document support stand and document holder shown in FIG. 1, with the document support stand partially broken away at portions thereof.

FIG. 4 is a perspective view of a document support stand, constructed in accordance with a second form of the present invention.

FIG. 4A is a front perspective view, partially broken away, of a document support stand, constructed in accordance with a modification to the form of the invention shown in FIG. 4.

FIG. 11 is a perspective view, partially broken away, of a document holder, constructed in accordance with a third form of the present invention.

FIG. 12 is a perspective view of a document holder, constructed in accordance with a fourth form of the present invention.

FIG. 13 is a perspective view, partially broken away, of a document holder, constructed in accordance with a fifth form of the present invention.

FIG. 31 is a cross-sectional view of the document support stand and locking mechanism shown in FIG. 30, taken along line 31—31 of FIG. 30.

FIG. 32 is a cross-sectional view of an alternative form of locking mechanism which may be used with the document support stand illustrated by FIG. 28.

FIG. 33 is a perspective view of a spacer member adapted for use with the document support stand shown in FIG. 28.

FIG. 34 is a longitudinal cross-sectional view of another form of a locking device for use with the stand of FIG. 28, the device being shown in an unlocked state.

FIG. 35 is a longitudinal cross-sectional view of the device shown in FIG. 34 in a locked state.

FIG. 36 is a perspective view of a rotatable stand constructed in accordance with another embodiment.

FIG. 37 is an exploded side elevational view of the stand shown in FIG. 36.

FIG. 38 is a side elevational view of a pin block used in conjunction with the rotatable stand shown in FIG. 36.

FIG. 39 is a perspective view of a pair of sleeves used for securing a document holder to a document support stand, and formed in accordance with the present invention.

FIG. 40 is a perspective view of the sleeves shown in FIG. 39, shown securing a document holder to a support stand.

FIG. 41 is a perspective view of an alternative form of document holder, constructed in accordance with the present invention.

FIG. 42 is a perspective view of another form of a document holder, constructed in accordance with the present invention.

FIG. 43 is a perspective view of another document holder, formed in accordance with the present invention.

FIG. 44 is a perspective view of an alternative form of an adapter constructed in accordance with the present invention.

FIG. 45 is a perspective view of a document holder and stand, formed in accordance with the present invention and modified to include a locking mechanism.

FIG. 46 is a top perspective view of a document support stand having a number of document holders mounted thereon, which stand is formed in accordance with the present invention.

FIG. 47 is a bottom perspective view of a document holder formed in accordance with the present invention.

FIG. 48 is a bottom perspective view of a document holder formed in accordance with the present invention.

DETAILED DESCRIPTION OF THE PREFERRED EMBODIMENTS

Figures 1, 3:
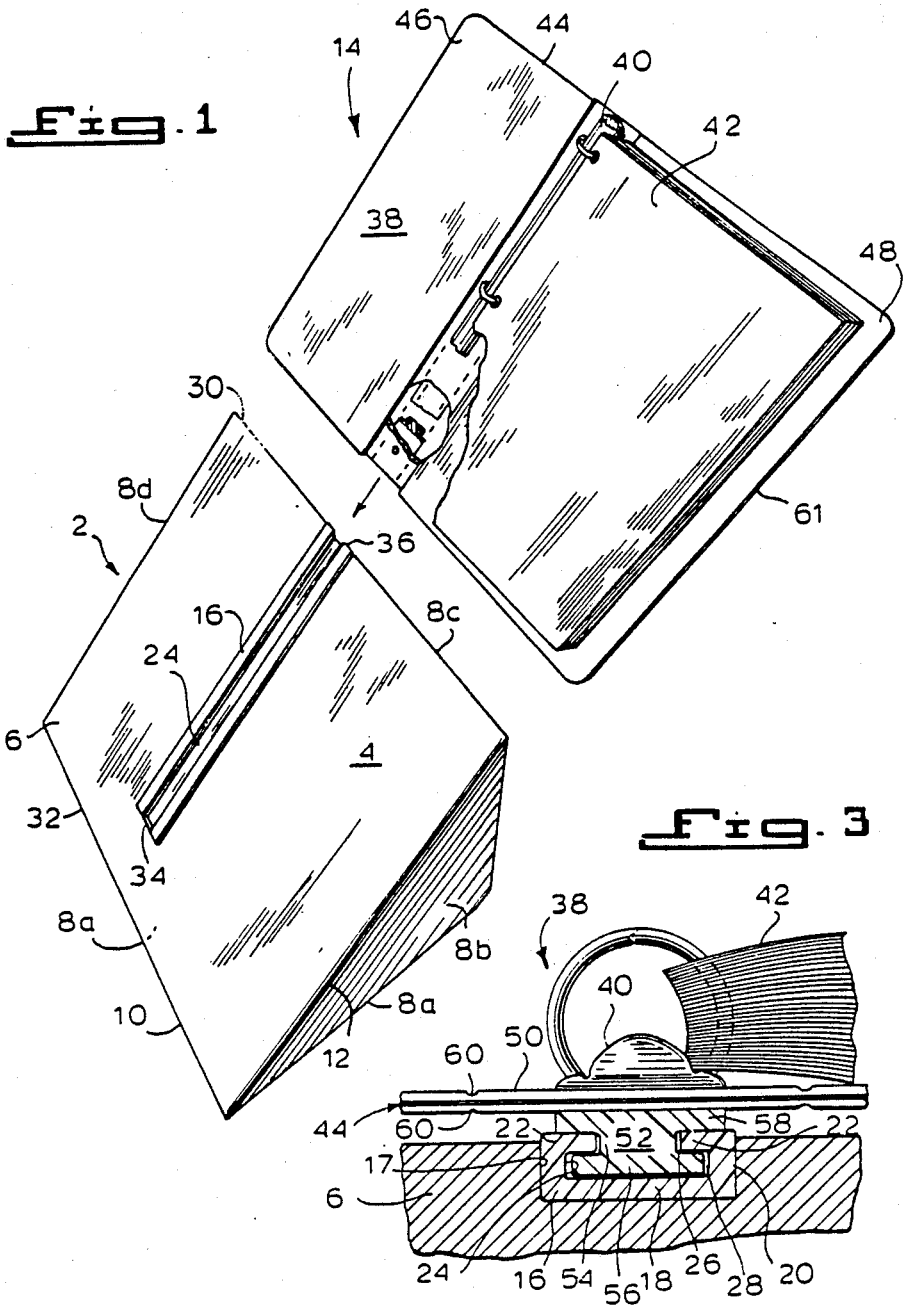
FIG. 1 is a front perspective view of a document support stand a document holder, constructed in accordance with one form of the present invention.
FIG. 3 is a fragmentary top view of the document support stand shown in FIG. 1, with the document holder mounted thereon.

Initially referring to FIGS. 1 and 2, it will be seen that a document support stand 2, constructed in accordance with one form of the present invention, includes a main body 4 formed in the shape of a truncated pyramid. The body 4 may be of solid construction, for enhanced stability, or formed from a series of joined or integral sides to provide the overall configuration of the truncated pyramid.

In this form of the invention, the main body 4 includes a viewing side 6 (defined by the base of the truncated pyramid construction), and four support sides 8*a*, 8*b*, 8*c*, 8*d* (defined by the truncated pyramid's mutually converging sides). The viewing side 6 is planar in nature, to provide a flat surface for holding and viewing a document mounted thereon, as will be explained. The four support sides 8*a–d* are also planar, to provide a stable, flat surface on which the stand may rest when positioned on a desk or table top or other horizontal support surface.

In the embodiment illustrated by FIGS. 1 and 2, only two sides 8*a*, 8*b* are of importance in supporting the stand, although four sides provide greater versatility in positioning the stand on the desk or table top. The two sides 8*a*, 8*b* which are used for support are transversely disposed to each other (each being joined to one of transversely disposed first and second edges 10, 12 of the viewing side), and define adjacent sides of the truncated pyramid body. Referred to hereinafter as the first and second support sides 8*a*, 8*b*, they extend angularly from the viewing side 6 on the same side of the plane in which the viewing side resides.

The viewing side 6 is disposed at a substantial angle to the horizontal in order to minimize eye strain and light reflection. Preferably, the angle A defined by the first support side 8*a* and the viewing side 6 (at the first edge 10), and the angle B defined by the second support side 8*b* and the viewing side 6 (at the second edge 12), are each about 40° to provide the desired angle of viewing. If each angle is selected to be the same, then the 40° slope of the viewing side 6 with respect to the desk or table top will be maintained in all dispositions of the stand, that is, when the stand is resting on any support side 8*a*, 8*b*. However, it may be desirable to form the stand with different angles A and B, for example, 40° and 50° respectively, so that the user may select his preferred viewing angle by merely rotating the stand to rest on a corresponding support side 8*a*, 8*b*.

Sides 8*c* and 8*d* are similarly joined to edges of the viewing side 6, with side 8*c* opposite side 8*a* and side 8*d* opposite side 8*b*, and similarly define angles C and D respectively with the viewing side. It may be desirable to form the body 4 with different angles A and C, for example 40° and 50° respectively, or with different angles B and D, so that the reader may rotate the stand 180° for different viewing angles.

The viewing side 6 is preferably rectangular in shape, and of sufficient dimensions to adequately support a loose-leaf binder or other document holder. The size of the stand, and its viewing side, is selected to fit the needs of the user and the document holders envisioned to be supported.

The document support stand 2 further includes a provision for mounting a document holder 14 on the main body 4. In one form of the invention, an elongated bracket 16 having a C-shape in cross-section is mounted in a recess 17 formed in the surface of the viewing side 6 of the body 4. As shown in FIG. 3, the bracket 16 includes a back plate 18, a pair of side plates 20 joined to the back plate 18 on the back plate's opposite transverse edges and extending perpendicularly from the back plate on the same side of the back plate, and a pair of inwardly facing arms 22, each arm 22 being joined to a respective side plate 20 and being spaced apart from the back plate 18.

The C-bracket 16 defines an elongated, T-shaped slot 24, having narrowed and widened portions 26, 28. The narrowed portion 26 of the T-slot 24 is defined between the pair of arms 22, while the widened portion 28 of the T-slot 24 is defined between the back plate 18 and each arm 22.

The bracket 16 is mounted on the main body 4 of the stand 2 with its back plate 18 abutting against the recessed surface of the viewing side 6. Fasteners, glue or other means may be employed to mount the bracket 16 in the recess 17.

The C-bracket 16 mounted in the recessed surface of the viewing side 6 may extend entirely across the viewing side, or may extend from one edge of the viewing side (shown in FIG. 1 as the top edge 30) and terminate before reaching the opposite edge (for example, the bottom edge 32). The terminated edge 34 of the bracket 16 defined by the end of the recess 17 provides a stop, which limits the extent to which a document holder 14 may be received by the bracket 16. This prevents the document holder 14 from inadvertently slipping out of the bracket slot 24 when mounted on the stand 2, and also lets the user know that the holder is fully and properly mounted on the stand.

As mentioned above, at least one end 36 of the bracket 16 extends to an edge of the viewing side 6. Thus, this end 36 is exposed, and is open to the slot 24 so that a document holder 14 may be slidably received by the slot through the exposed open end 36.

Thus, the stand may be described as being rotatable about a z-axis of rotation running through the body 4, with the viewing side 6 residing in an x-y coordinate plane that is perpendicular to the z-axis of rotation so that the viewing side of the stand correspondingly turns within the x-y coordinate plane and is adjustable in position within the x-y coordinate plane.

Figure 15:
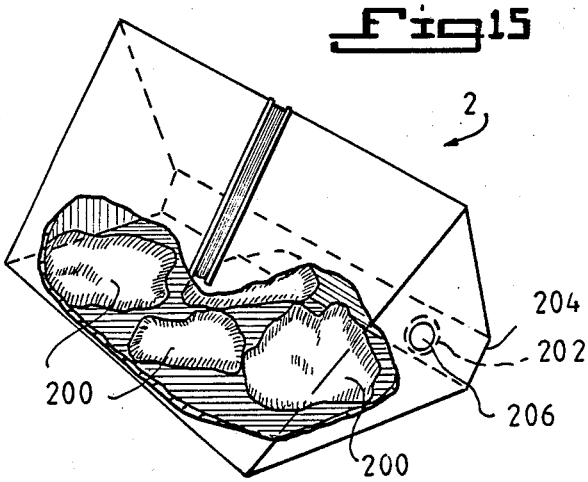
FIG. 15 is a perspective view of a document support stand, partially broken away, formed in accordance with another embodiment.

In another form of the invention, as illustrated by FIG. 15, the document support stand 2 may be hollow, with its sides completely enclosing its interior. An unattached, weighted means 200 is inserted into the hollow interior of the stand and confined within the interior by the stand's sides. The weighted means 200 is movable and will fall to whichever support side the stand is resting on whenever the document stand 2 is repositioned.

This particular embodiment is advantageous in that it allows the center of gravity of the document stand to change to the optimum position for preventing the stand from toppling over under the weight of the document which it supports.

Also, the document support stand 2 of FIG. 15 may be manufactured from a plastic or other lightweight material so that most of its weight can be attributed to the movable weight 200. Thus, the document support stand 2 will always maintain a low center of gravity no matter what support side it rests on, further adding to the stability of the stand.

Furthermore, having a movable weight 200 provides for economy of manufacture because the stand may be formed without any real concern for the weight distribution of its parts and how they relate to function.

The weighted means 200 used in the document support stand 2 of FIG. 15 may be one of a variety of different materials or objects, including small bags of peas, beans or gravel, loose sand or liquid. The weighted means 200 may be introduced into the interior of the support stand through an access opening 202 formed in one of the sides of the stand (preferably the unused top side 204). The opening 202 may be threaded to receive and secure to the stand a threaded cap 206 which is flush with the outer surface of the top side 204 and, if water is used as the weighted means 200, may be formed to define a watertight closure for the stand.

FIG. 3, in association with FIGS. 1 and 2, illustrates one form of a document holder 14 constructed in accordance with the invention, and demonstrates how that document holder is mounted on the document support stand 2.

A conventional loose-leaf binder 38, having a binder mechanism 40 to hold pages or documents 42, and a jacket 44 having a front and back cover 46, 48, with the binder mechanism 40 mounted on the inside surface of the jacket at its spine 50, is modified to further include an elongated rail 52 mounted on the outside surface of the jacket 44 at or near the spine 50. The elongated rail 52 has a T-shape in cross-section with narrowed and widened portions 54, 56 that correspond in dimensions to the widened and narrowed portions 28, 26 of the slot 24 defined by the C-bracket 16. The T-rail 52 may include a back plate 58 mounted on the narrowed portion 54 and spaced from its widened portion 56 for mounting the rail on the loose-leaf binder jacket, such as by gluing, fasteners or other means. Or, the T-rail 52 may be integrally formed with the jacket when the loose-leaf binder is made.

As shown in FIGS. 1 through 3, the loose-leaf binder-type document holder 14 is removably mounted on the document support stand 2 by sliding its T-rail 52 through the expose end 36 of the C-bracket 16 into the bracket's T-slot 24 until the document holder is centered on the viewing side 6 or abuts the terminated end 34 of the C-bracket.

The C-bracket 16 of the stand 2 securely holds the document holder 14 and supports it at its spine 50. Most loose-leaf binders are adapted to fold about the binder mechanism and the documents held thereby to protect the documents, and are made to flex at fold lines or creases 60 running parallel to the spine 50. The loose-leaf jacket 44 provides poor support when stood on its side edges 61, because it has a tendency to flex at its fold lines. The best support for the loose-leaf binder is thus provided by positioning the T-rail 52 at the spine 50 of the loose-leaf jacket, where the most weight of the loose-leaf binder and where the fold lines 60 are situated.

Thus, the loose-leaf binder 38 may be repositioned by the reader to different viewing dispositions, for instance, for changing a reading pattern of from left to right to top to bottom, without manipulating the document holder on the stand 2, simply by rotating the stand 90 so that it rests on a different support side **8*a*, 8*b***.

Figure 3A:
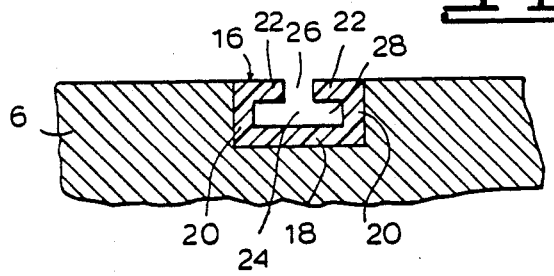
FIG. 3A is a fragmentary sectional view of the document support stand shown in FIG. 1, illustrating one form of the viewing side thereof.

FIGS. 1 through 3 show the C-bracket 16 protruding slightly above the surface of the viewing side 6. It may be desirable to mount the C-bracket 16 flush to the surface of the viewing side 6, as illustrated by FIG. 3A, or slightly deeper in the viewing side 6 to compensate for the thickness of the T-rail's back plate 58, so that the jacket 44 substantially rests on the surface of the viewing side 6 for flat support over more of the loose-leaf jacket's area. However, it is envisioned to be within the scope of this invention, and may also be desirable, to mount the C-bracket 16 directly on the surface of the viewing side, without forming a recess 17 in the viewing side 6, so that a slightly backward bend to the loose-leaf cover is provided which tends to further maintain the loose-leaf binder 38 in an open condition when disposed with its spine 50 horizontal.

Figure 3B:
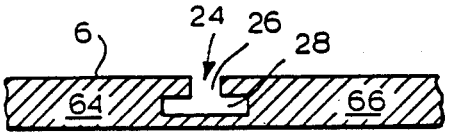
FIG. 3B is a fragmentary sectional view of the document support stand shown in FIG. 1, illustrating another form of the viewing side thereof.

Of course, it is also envisioned to be within the scope of this invention to eliminate a separate C-bracket member 16 and to form the T-slot 24 directly in the surface of the viewing side 6, as illustrated by FIG. 3B. In such a case, the narrowed and widened portions 26, 28 of the T-slot 24 are defined by first and second portions 64, 66 of the viewing side, the first and second portions 64, 66 being L-shaped and in relative mirror image disposition, as illustrated.

Figures 19, 20, 21, 22, 23, 24:
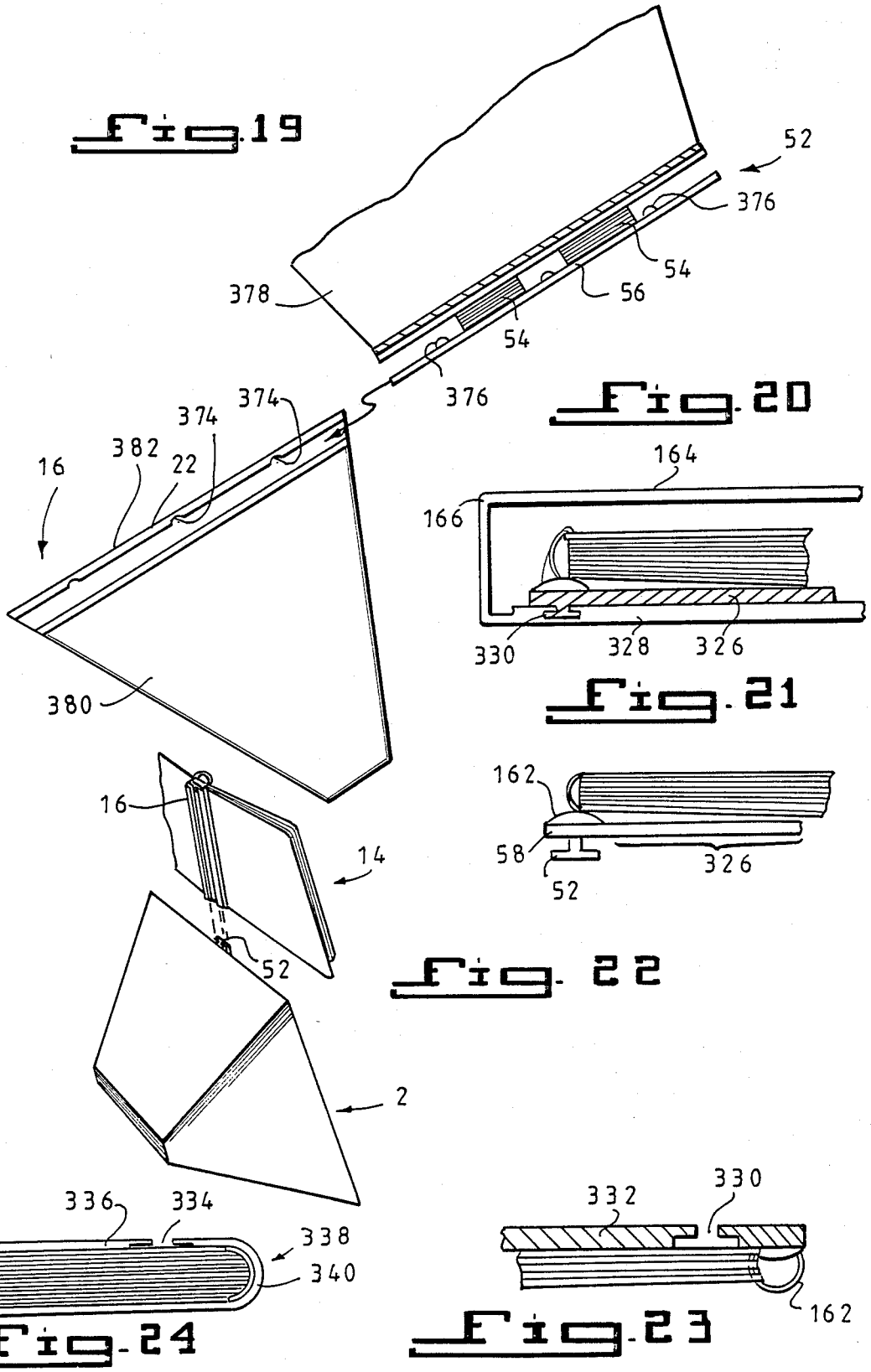
FIG. 19 is a longitudinal cross-sectional view of portions of the document holder and stand, illustrating another form of a latching mechanism.
FIG. 20 is a cross-sectional view of an alternative form of the binder-type document holder shown in FIG. 10.
FIG. 21 is a side elevational view of the T-rail and binder mechanism of the document holder shown in FIG. 20.
FIG. 22 is a rear perspective view of a document holder and a document support stand, similar to that shown in FIG. 2, modified in accordance with another form of the present invention.
FIG. 23 is a transverse cross-sectional view of a loose-leaf binder-type document holder, shown without the jacket, formed in accordance with another form of the invention.
FIG. 24 is a transverse cross-sectional view of another document holder formed in accordance with another form of the present invention.

It is further envisioned to reverse the positions of the T-rail 52 and the C-bracket 16 or T-slot 24. For example, as illustrated by FIG. 22, the C-bracket 16 may be mounted on the document holder 14, and the T-rail 52 may be mounted on the support stand 2 with comparable results.

FIG. 4 illustrates a second form of a document support stand, constructed in accordance with the present invention. This alternative form of the stand includes a main body 70 formed as a one-piece, plate-like member bent into three non-parallel, planar dispositions to define three integral sides. One side 72 is the viewing side of the stand; the other two sides are first and second support sides 74, 76. Each of the viewing and support sides 72–76 perform a similar function to that performed by the sides of the stand shown in FIGS. 1 through 3, and define similar angles A and B therebetween, as in the first embodiment described.

An elongated slot 78 is formed directly in the viewing side 72 of the plate-like body 70, and extends from the top edge 80 of the stand and across the viewing side 72, and terminates short of the fold 82, as illustrated by FIG. 4. The thickness of the plate surrounding the slot 78 is substantially equal to the space defined between the back plate 58 and the widened portions 56 of the T-rail 52 of the document holder, as shown in FIG. 3, and the width of the slot 78 conforms to the width of the narrowed portion 54 of the T-rail. Thus, the document holder is slidably mountable on the document support stand, with its T-rail 52 being securely captured within the slot 78 formed in the viewing side of the stand.

It is evident from the above description that the second support side 76 may be eliminated, as illustrated by FIG. **4*a*, with the possible sacrifice of some stability to the stand. The modified stand would then be comprised of the viewing side 72 and the first support side 74. The side edges 84, 86 of the viewing side 72 and the first support side 74 constitute the support for the stand when it is rotated 90° from the position shown in FIGS. 4 and 4*a*, so that the stand rests on these edges 84, 86**.

As in the other embodiments, the first and second support sides 74, 76 of the stand of FIG. 4 define a 40° angle with the viewing side 72 so that the viewing side is disposed at a substantial angle to the desk or table top to lessen eye strain and fatigue. In the modified stand of FIG. 4*a*, the side edge 86 of the first support side 74 resides in a plane which defines a 40° angle with the viewing side 72.

To increase stability of the edge supported stand shown in FIG. 4*a*, a weight 88 may be added. The weight 88 is mounted on the first support side 74 near its side edge 86. The weight 88 lowers the center of gravity of the stand when it is disposed on its side edge, and minimizes the chance of the stand toppling under the weight of the document holder.

Figure 16:
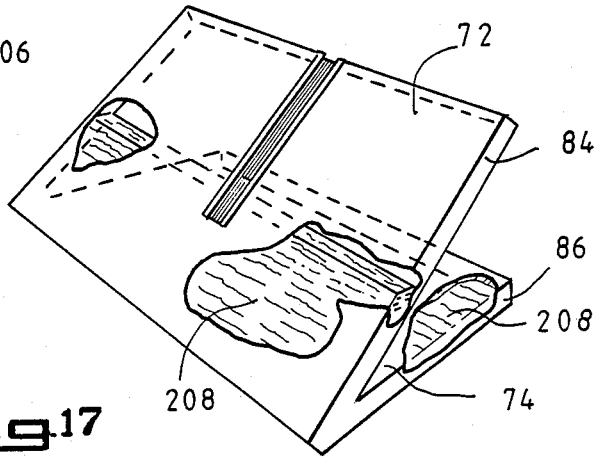
FIG. 16 is a perspective view of the document support stand shown in FIG. 4A, partially broken away, modified in accordance with another embodiment of the present invention.
Figure 17:
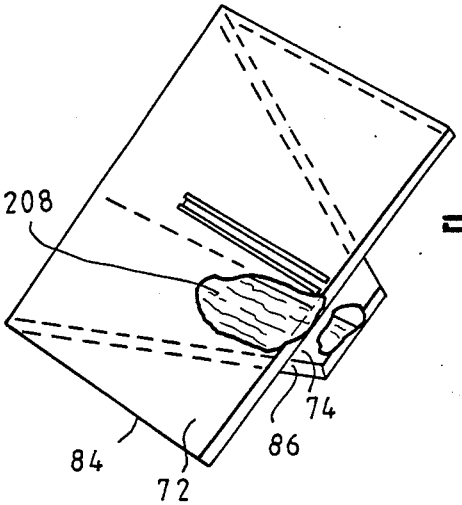
FIG. 17 is a perspective view of the stand shown in FIG. 16, shown in a different rest position.
Figure 17:
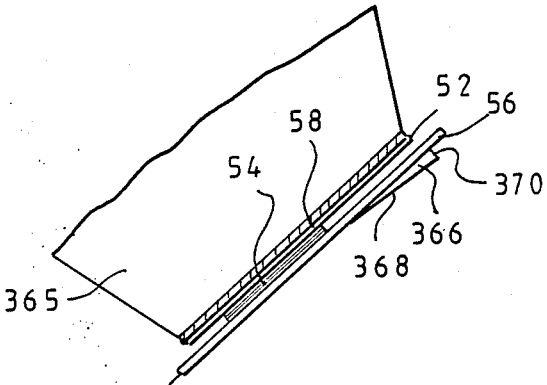

Alternatively, the stand of FIG. 4A may be made of hollow sides 72, 74, as shown in FIG. 16, to receive and retain a moveable ballast 208 or weight, such as water or loose sand. The hollow interiors of each side 72, 74 may be in communication to allow the moveable ballast 208 to flow from one side to the other. The loose ballast 208 partially fills the interior of each side and thus occupies the lower interior portion of each side. When the stand is repositioned, as shown in FIG. 17, the water or sand will shift accordingly and will help hold the stand upright in the new position. The same feature of hollow sides containing a loose and moveable ballast may be incorporated in the stand shown in FIG. 4, described previously, and that shown in FIG. 6, which is to be described.

Figure 5:
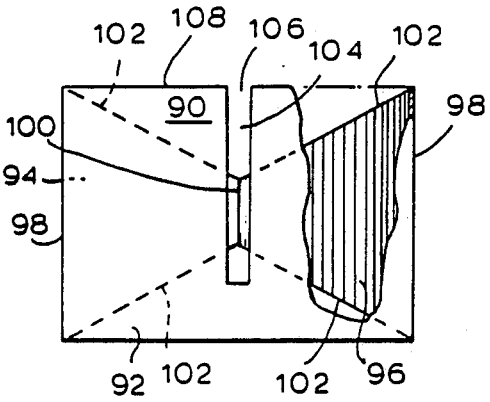
FIG. 5 is a front elevational view, partially broken away, of a document support stand, constructed in accordance with a third form of the present invention.

FIG. 5 shows a third form of the document support stand, and combines the features of the stands shown in FIGS. 1 through 3 and FIGS. 4 and 4A. The stand includes a body 90 having an overall pyramid or truncated pyramid geometric shape, as with the first stand described (FIGS. 1–3), but which is only three sided and edge supported in one of its dispositions, as well as being formed from a bent plate-like member, as in the second embodiment of the stand and its modification (FIGS. 4 and 4A).

The main body 90 of the stand includes a rectangular, planar viewing side 92 (the base of the pyramid configuration), and two planar support sides 94, 96 joined to the opposite edges of the viewing side. Each support side 94, 96 defines with the viewing side 92 an acute angle, preferably about 40°, along the opposite edges 98 of the viewing side. The support sides 94, 96 extend from the viewing side 92 on the same side of the plane in which the viewing side resides, and mutually converge towards the rear of the stand to join each other and define a back edge 100.

Each support side 94, 96 is trapezoidal in shape, and includes exposed side edges 102. These side edges 102 are used to support the stand on a desk or table top, as exemplified by the disposition of the stand shown in FIG. 5. The side edges 102 of the support sides 94, 96 preferably reside in planes which define angles of 40° with the viewing side 92, so that the viewing side 92 is disposed at the same angle with respect to the desk or table top with the stand in any user selectable disposition. Alternatively, as in the embodiment shown in FIGS. 1 through 3, the angles of the support sides 94, 96 and side edges 102, with respect to the viewing side 92, may be selected to provide different viewing angles for different dispositions of the stand.

As in the stand shown in FIGS. 4 and 4A, the stand of FIG. 5 has an elongated slot 104 formed in its viewing side 92, with an open end 106 of the slot disposed at the viewing side's top edge 108. The elongated slot 104 is dimensioned to receive the T-rail 52 of a document holder, such as that of the holder described previously and shown in FIG. 3.

The stand of FIG. 5 can be rotated to rest on either of the support sides 94, 96, or on the exposed edges 102 of the support sides, so that the slot 104 will be either vertically or horizontally disposed. A document holder thus received by the slot and secured to the viewing side 92 of the stand is displayable in different dispositions, to change reading patterns, for instance, for left to right or top to bottom viewing, without manipulating the document holder on the stand, by merely rotating the stand so that it rests on its support sides 94, 96 or the side edges 102 of the support sides.

Figure 6:
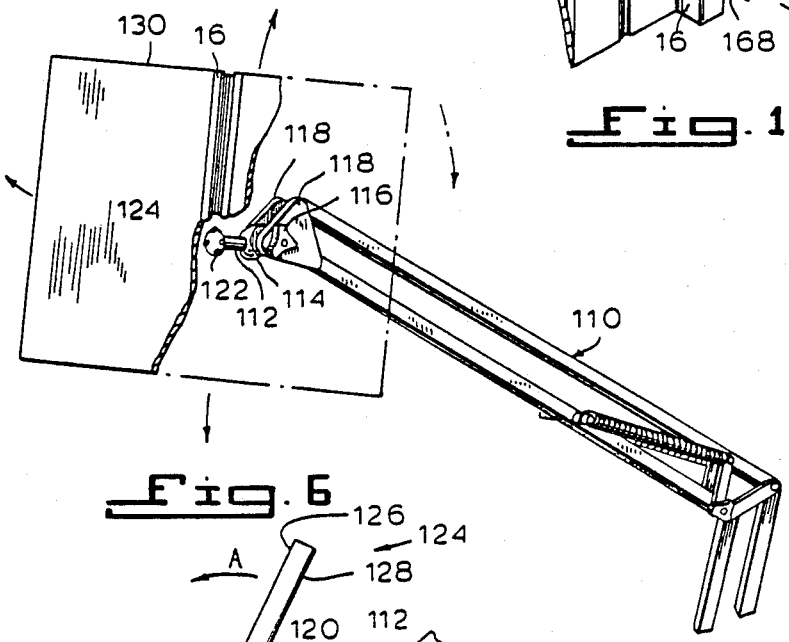
FIG. 6 is a perspective view, partially broken away, of a document support stand, constructed in accordance with a fourth form of the present invention.
Figure 7:
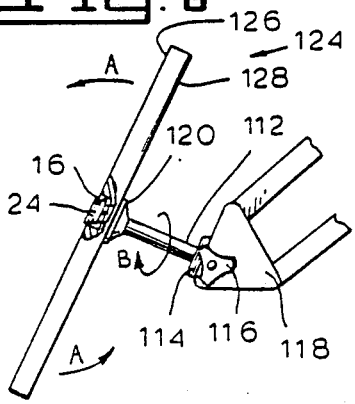
FIG. 7 is a fragmentary side view of the document support stand shown in FIG. 6, with the main body of the stand rotated 90° from the viewing position shown in FIG. 6.

Referring now to FIGS. 6 and 7, a fourth form of a document support stand, constructed in accordance with the present invention, is shown. In this form of the invention, a document holder may be suspended above the workplace and may be adjusted both in viewing angle and in its rotation.

The document support stand first includes a conventional, double-arm multi-function support bracket 110. Such brackets are typically used for supporting a swing arm type lamp over a desk top, drafting table or the like, and are usually mounted at the edge of the desk or table. Such a support bracket is used on the swing-arm lamp Model No. 173-7500, manufactured by Electrix, Inc.

The support bracket 110 includes a pinion 112 which is rotatably held by a sleeve 114. A knob 116 can adjust the pressure that the sleeve 114 exerts on the pinion 112 and the degree to which the pinion is rotatable.

The sleeve 114 is clamped between two side brackets 118, so that the sleeve, and the pinion 112 held by the sleeve, are angularly adjustable from the vertical. The angular disposition of the pinion 112 selected by the user may be maintained by tightening the knob 116, which increases the side brackets' holding force on the sleeve 114.

The pinion 112 includes a flange 120 mounted on its free end. Holes 122 are formed on the flange 120 for receiving screws or other fasteners for mounting a lamp or other object to the support bracket.

In the present invention, a planar plate-like member 124, rectangular in form, is mounted on the flange 120 of the support bracket 110. The plate-like member 124 includes a front side 126, constituting the viewing side of the document support stand, and an opposite rear side 128, to which the flange 120 of the support bracket is attached.

As in the other previously described embodiments, the document support stand of FIGS. 6 and 7 includes a provision for mounting a document holder to the stand. The same forms of the document holder mounting structure used in the other stands of the invention may be employed here. For example, the C-bracket 16 shown in FIG. 3 may be mounted on the surface of the viewing side 126 of the plate-like member 124, or mounted flush to the surface in a recess formed in the viewing side 126. Alternatively, as exemplified by FIG. 3B, a T-slot 24 may be formed directly in the member and defined by L-shaped member portions 64, 66.

As a further alternative, the member 124 may be a relatively thin plate formed with an elongated slot, as employed in the stands of FIGS. 4 and 4A, with the mounting flange 120 of the support bracket 110 being positioned on the rear side of the member so as not to interfere with the slot.

Depending on the means employed to define the slot 24 in the member, the slot may be open at an edge 80 of the member so that the corresponding T-rail 52 of a document holder, such as that previously described and shown in FIG. 3, may be slidingly received by the slot 24 and secured to the viewing side 126 of the stand.

The document support stand of FIGS. 6 and 7 provides different angles of viewing for the reader by loosening the knob 116 and adjusting the member 124 up or down, as illustrated by arrows A in FIG. 7. A document holder secured in the slot 24 on the viewing side 126 of the stand may be rotated to different viewing dispositions (by the pinion 112 turning in the sleeve 114, as indicated by arrow B), for example, the different positions shown in FIGS. 6 and 7, so that the reader may quickly and efficiently adjust his reading pattern, without manipulating the document holder on the stand.

Thus, like the stand of FIG. 1, the stand shown in FIG. 6 may be described as being rotatable about a z-axis of rotation running through the plate-like member 124, with the front or viewing side 126 residing in an x-y coordinate plane that is perpendicular to the z-axis of rotation so that the viewing side of the stand correspondingly turns within the x-y coordinate plane and is adjusted in position within the x-y coordinate plane.

Figure 9:
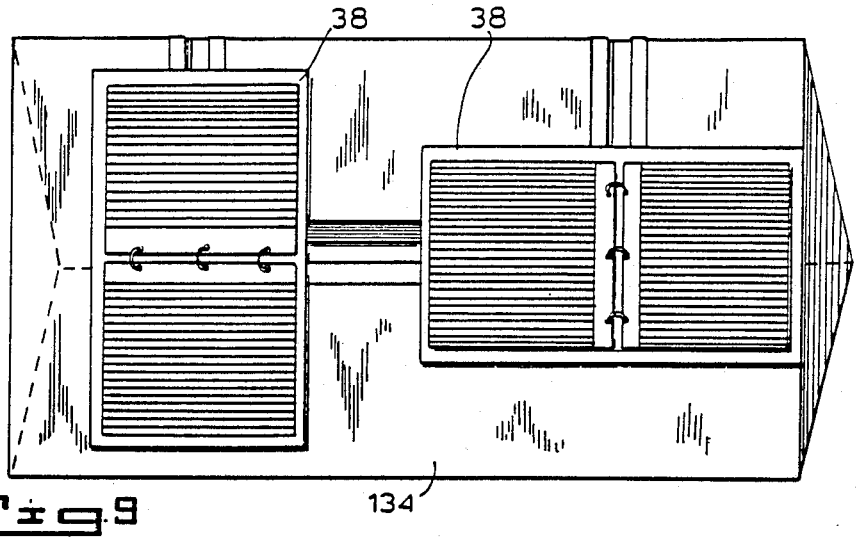
FIG. 9 is a perspective view of the document support stand shown in FIG. 8, with a pair of loose-leaf binders mounted in different dispositions on the stand.
Figure 8:
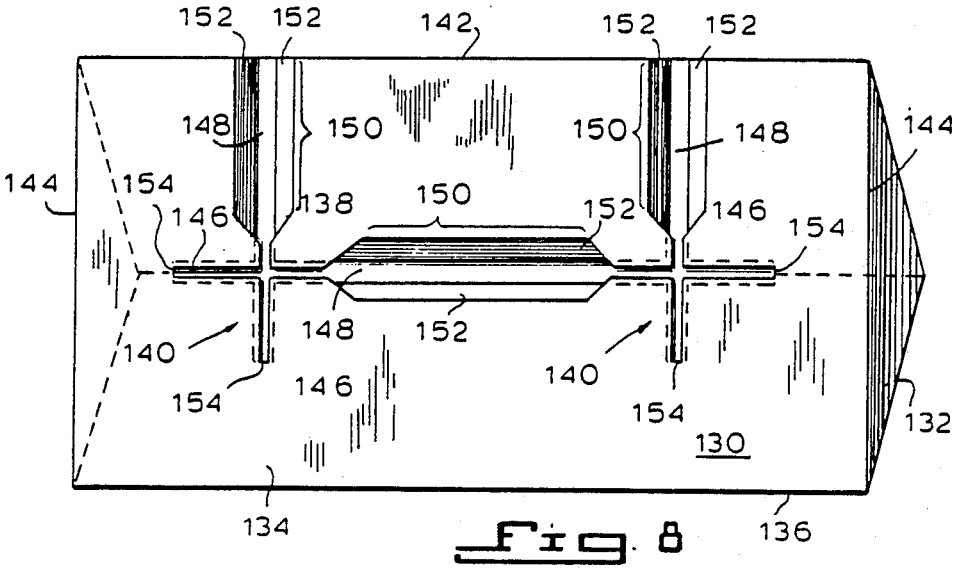
FIG. 8 is a front perspective view of a document support stand, constructed in accordance with a fifth form of the present invention.

Another form of a document support stand is shown in FIGS. 8 and 9. This form of the invention has the capability of securely but removably holding one or more document holders 14 in multiple viewing dispositions on the stand.

The document support stand includes a main body 130 which may be formed as an upstanding wedge-shaped block (i.e., triangular in section). The body 130 has a flat support side 132 which is provided for resting the stand on a desk or table top. It also includes a viewing side 134, disposed at a substantial angle to the desk or table top. The support side 132 and viewing side 134 are joined at a common edge 136, and define between them an acute angle of preferably about 40°.

Other forms of the main body 130 may be employed, rather than the triangular shape shown in FIGS. 8 and 9. For example, a plate-like member (such as that shown in FIGS. 6 and 7), having its front side constituting the viewing side of the stand, and including a support bracket extending angularly from its rear side to the desk top, may be suitably used. Other forms of the main body are envisioned and may be employed, as long as each presents a viewing side for mounting various document holders.

The surface of the viewing side 134 is formed with at least one horizontally disposed T-slot 138, and with at least one vertically disposed T-slot 140, although FIG. 8 shows two vertical slots 140 as the preferred number. The vertical slots 140 extend from the top edge 142 of the stand's viewing side and terminate short of the bottom edge 136. In the preferred form of the stand shown in FIG. 8, the horizontal slot 138 is interposed between the two vertical slots 140 and extends slightly beyond each. The horizontal slot 138 terminates short of two side edges 144 of the viewing side 134, although it may extend to the side edges, in the same fashion as the vertical slots 140 extend to the top edge 142.

The T-slots 138, 140 formed in the surface of the viewing side 134 are substantially the same as the slot 24 defined by the C-bracket 16 shown in FIG. 3, or defined by the viewing sides of the other stands, as shown in FIGS. 3A and 3B. That is, the slots 138, 140 are formed with narrowed portions 146 at the surface of the viewing side 134, and widened portions 148 more recessed from the surface, so that each slot is adapted to receive the complementary shaped T-rail of the document holders.

If both the horizontal and vertical T-slots 138, 140 are formed to extend to the edges of the viewing side 134, their ends are open and exposed so that the document holder's rail may be slid into the open end of the slots.

However, it may be desirable to seat the document holder's rail in either slot 138, 140 by approaching the slot in a direction normal to the viewing side 134 (as opposed to sliding the holder in the slot's exposed end). As shown in FIG. 8, this preferred form of the stand includes portions of the viewing surface which define an enlargement 150 in each slot, which enlargement 150 extends only partially over the length of its respective slot.

The width of the enlargement 150 is equal to or greater than that of the widened portion 56 of the T-rail 52 on the document holder. This enlargement may be in the form of a concave depression defined by inwardly sloping, recessed portions 152 of the viewing side's surface disposed on opposite sides of the slot, which converge into the widened portion 148 of the slot. The concave depression formed in the viewing side is perfectly adapted for receiving a loose-leaf binder with a convex spine.

The document holder 14 may be positioned at the enlargement with its T-rail 52 received by the widened portion 148 of the slot. The holder 14 is then shifted axially along the slot away from the enlargement 150, where its T-rail 52 is held captive by the narrower portion 146 of the slot. The document holder is properly seated on the stand when its T-rail engages the terminated end 154 of the slot.

As illustrated by FIG. 9, a pair of loose-leaf binder-type document holders 38 may be securely held at one time by the document support stand. Thus, the same documents or similar documents may be displayed concurrently, allowing the reader to view the documents in left to right or top to bottom fashion.

FIGS. 28–32 illustrate modifications to the basic stand shown in FIGS. 8 and 9.

The main body 210 may be formed as a flat board, if desired, and, although it may be supported at any angle, including vertically, by a support bracket or the like, it may also lie horizontally and be mounted on a table top or the like. As such, it may be desirable to form the stand with T-slots 212 which open on the bottom edge 214 of the stand as well as on the top edge 216, as illustrated, or from each side. This will make the stand more versatile and adaptable for use under many conditions.

Figure 28:
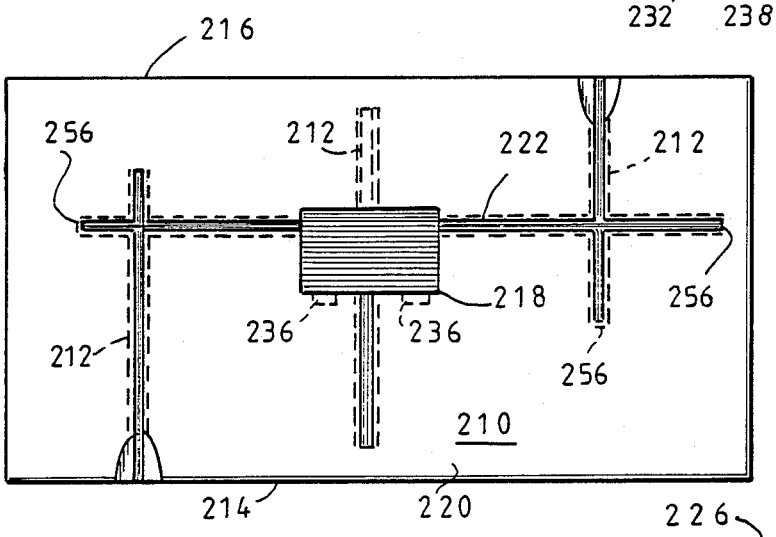
FIG. 28 is a front elevational view of a document support stand similar in many respects to that shown in FIGS. 8 and 9 but adapted to receive a locking mechanism.

FIG. 28 shows the stand with a major enlargement 218 formed in its center. The enlargement 218 is basically a cutout, where the top surface of the viewing side 220 down to the level of the bottom of the T-slots 212 is removed. The enlargement 218 may be square or rectangular, or take on another shape; however, the major enlargement 218 is dimensioned to provide access to both vertical T-slots 212 and horizontal T-slots 222 formed in the stand and, consequently, is positioned to encompass the intersection of the two slots 212, 222. The width and height of the major enlargement 218 is selected to be at least equal to the length of the T-rails of the document holders envisioned to be used, such as the looseleaf type binder 224 and clipboard type holder 226 shown in FIG. 30, and as described in relation to FIGS. 1 and 11, respectively.

As with the embodiment of FIGS. 8 and 9, the document support stand of FIG. 28 may accept document holders from the top and bottom edges 216, 214, or directly from the viewing side 220 into the major enlargement 218, whereupon the T-rail of the document holder is slid into one of the vertical or horizontal T-slots 212, 222 to which the major enlargement is in communication.

To prevent the document holders from being removed from the stand and, more preferably, to prevent documents from being removed from the document holders once they are mounted on the stand, a locking device 228 may be employed.

In its most basic form shown by FIGS. 29–32, the locking device 228 is a square or rectangular block 230 dimensioned to conform to the shape of the major enlargement 218 so that it can be received by the major enlargement. The block 230 preferably has a depth which is equal to the depth of the major enlargement 218 so that it will lie flush with the surface of the viewing side 220 of the stand when properly situated in the major enlargement.

The locking block 230 may include two extended portions 232, situated on and protruding from the bottom edge surface 234 of the block, which extended portions may be received by two similarly shaped slots 236 formed below the surface of the viewing side 220.

The locking block 230 also may include several raised portions 238 situated on the top surface of the block and disposed to be in alignment with the T-slots of the stand. The purpose of such raised portions 238 will be described.

The locking device 228 further includes a key-type lock mechanism 240. Several different types are envisioned to be suitable for use. For example, as shown in FIG. 31, the lock mechanism 240 is a barrel-lock type, such as disclosed in U.S. Pat. No. 4,475,365, where pins 242 protrude from a shaft 244 of the lock and are received in corresponding apertures formed in the stand.

Another type of lock mechanism 240 suitable for use is illustrated by FIG. 32. A pivoting plate-like arm 246 is moveable into and out of engagement with a slot formed below the surface of the viewing side 220 of the stand, opposite the side on which the extended portions 232 of the block are situated. Such a lock mechanism is described in U.S. Patent Nos. 4,462,317 and 4,341,166.

Figure 30:
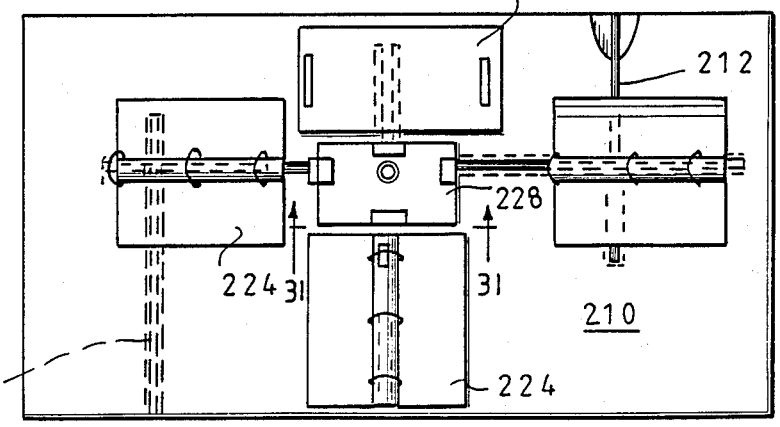
FIG. 30 is a front elevational view of the document support stand shown in FIG. 28, with the locking mechanism shown in FIG. 29 attached to it.

Once the document holders 224, 226 are positioned in their respective T-slots 212, 222 on the document support stand, as shown in FIG. 30, the extended portions 232 of the locking block 230 are fitted into their corresponding slots 236, and the block is maneuvered into the major enlargement 218 so that it is flush with the surface of the viewing side. The key lock mechanism 240 is then manipulated so that the block is secured to the stand.

The block 230 closes the major enlargement 218 so that none of the document holders in the T-slots 212, 222 which are in communication with the major enlargement 218 may be removed.

As described previously, the locking block 230 has a number of raised portions 238. The purpose for these raised portions is to prevent documents from being removed from the document holders which are locked on the stand. The type of document holder which is envisioned to be perfectly adaptable for use on the support stand shown in FIG. 28 is the loose-leaf binder-type that has a reciprocatingly slidable actuator in the form of an L-shaped bracket 248 (See FIG. 35) which extends from the binder mechanism. The L-shaped bracket 248 slides in and out of the mechanism to close and open the binder rings, respectively. Such a binder-type holder is sold by Boorum and Pease in Elizabeth, N.J., a subsidiary of Esselte Business Systems, under Model No. 072-2SP. The height of each raised portion 238 of the locking block 230 is such that, when the document holders are properly mounted on the stand with the locking block 230 positioned in the major enlargement 218, the raised portions 238 of the block will contact and abut against the ends of the L-shaped brackets 248 of the holders. The L-shaped brackets 248 may not be pulled outwardly from the binder mechanism to open the binder rings because of interference with the raised portions 238 of the locking block. Thus, the locking block 230 will not only prevent the document holders from being removed from the stand, but it will also prevent the removal of documents from the document holders.

If document holders are to be used on the stand of FIG. 28, which holders are smaller than the length of the T-slots 212, 222 measured from their closed ends to the locking block 230, it is envisioned to use spacer members 250 to ensure that the L-shaped brackets 248 of the holders may not be manipulated to open the binder rings. One form of a spacer member 250 is shown in FIG. 33. It basically consists of a T-rail 252 on which an elongated block 254 is mounted. The spacer member 250 is inserted into the T-slot 212, 222 between the closed end 256 of the slot and the document holder, or between the document holder and the locking block 230. The spacer member 250 may be formed in a number of lengths so that one may be selected which will prevent the document holder from moving within the T-slot 212, 222 in which it is mounted.

Another type of locking mechanism 228 for use with the stand shown in FIG. 28 is shown in FIGS. 34 and 35. The mechanism basically consists of a protruding pin-type key lock 258, such as shown in FIGS. 3 and 4 of U.S. Pat. No. 4,691,541, or the plunger lock described in U.S. Pat. No. 4,009,599. The pin-type key lock 258 is mounted on a block 260 having a hole 262 formed through its thickness for receiving the extendible pin 259 of the lock. A pair of T-rails 264 are mounted on the block's underside. A raised portion 266, for contacting the L-shaped bracket 248 of the binder, if such type is used, may also be mounted on the block near one axial end thereof.

When the pin 259 of the pin-type lock is retracted, as illustrated by FIG. 34, the pin does not extend below the T-rails 264 of the locking mechanism 228. The mechanism may be slid onto a T-slot 212, 222 formed in the stand.

When the pin 259 is fully extended in order to lock a document holder to the stand, the free end of the pin extends below the T-rails 264 and into one of a plurality of spaced holes 268 formed in the stand at the bottom of the T-slot 212, 222.

Accordingly, the locking mechanism described above may be slid into the slot 212, 222 and positioned in contact with the L-shaped bracket 248 of the holder and then locked in that position. Not only will the mechanism 228 prevent the document holder from being removed from the stand, but it will also prevent the binder rings from being opened to remove documents.

Another embodiment of the invention, using the same type of extendible pin key lock or plunger lock described above, is illustrated by FIG. 45. The key lock assembly 258 may be mounted directly on the document holder, for example, the clipboard holder 170 shown in FIG. 11. The pin extends from the bottom of the clipboard holder 170 and, when the holder is mounted on the viewing side of the document support stand 269, is adapted to be received by an opening 270 formed in the viewing side (or, alternatively, in the C-bracket or T-slot 272) of the stand. The pin may be extended and retracted, and selectively locked in the extended position, so that when the pin engages the opening 270 of the stand, the document holder may not be removed from the stand as it cannot slide within the C-bracket or T-slot 272 of the stand. Alternatively, the pin key lock may be mounted on the stand and engage an opening formed in the document holder.

Of course, it is envisioned that the key lock assembly 258 may be mounted on various forms of document holders other than the clipboard holder 170 shown in FIG. 45, and that other types of stands, such as those shown in FIGS. 1, 6 and 8, may have an opening formed in their viewing sides so as to mount and lock a document holder modified as described above.

FIGS. 36–38 illustrate another embodiment of the present invention, that is, a rotatable turntable support 274 which is removably mountable on a document support stand such as shown in FIGS. 28–32, as well as the other stands described previously.

The rotatable turntable support 274 basically includes a plate-like body 276 having a T-slot 278 formed in its top surface, or a C-bracket internally defining a T-slot mounted on it at its top surface; a turntable assembly 280, such as a "lazy susan" type device, for example, such as manufactured by Triangle Manufacturing Co. in Oshkosh, Wis., and designated by Model No. 3C, the turntable assembly 280 having relatively rotatable top and bottom portions 282, 284 and being mounted by its top portion to the bottom surface of the body 276; and a T-rail 286 affixed to the bottom portion 284 of the turntable assembly.

The rotatable turntable support 274 is mounted on a document support stand, such as that described in conjunction with FIG. 28, by having its T-rail 286 received by the T-slot 212, 222 of the stand. A document holder, such as the binder-type manufactured by Boorum and Pease, previously mentioned, modified to include a T-rail, as described previously, is mounted on the plate-like body 276 of the turntable stand. In this manner, the document holder may be rotated on the document support stand without repositioning the stand.

It is also envisioned to be able to lock a document holder on the rotatable turntable stand 274 to prevent its removal. This may be accomplished by using the extending pin locking mechanism 258 illustrated by FIGS. 34 and 35, where two of such mechanisms are positioned in the T-slot 278 of the plate-like body 276 on each side of the holder. The pins of the locking mechanisms are received in one of a series of holes 288 formed in the plate-like body 276 at the bottom of the T-slot 278, as described previously in conjunction with the stand shown in FIG. 28.

The turntable stand 274 may also be selectively prevented from rotating by using the pin block 290 shown in FIG. 38. As its name implies, the pin block is basically a block 292 on which a T-rail 294 is mounted on its bottom side, and a pin 296 protrudes from one of its lateral sides. The pin block 290 slides into one of the T-slots of the document support stand on which the turntable stand 274 is mounted.

The turntable stand 274 includes a detent stop plate 298 interposed between the plate-like body 276 and the turntable assembly 280. The detent stop plate 298 includes a series of recesses or bores 300 formed in its lateral edges.

To keep the turntable stand 274 and, accordingly, the document holder, from rotating on the document support stand, the pin block 290 is slid against the lateral edge of the detent stop plate 298, with its protruding pin 296 received by a selected bore 300. This will hold the turntable stand in place.

To reposition the turntable stand 274 and document holder mounted on it, one merely has to slide the pin block 290 away from the turntable stand, reposition the stand and advance the block again so that its pin 296 engages another recess 300 in the detent stop plate 298.

It is also envisioned to make the document holder illustrated by FIG. 41. Such a holder permits the interchanging of conventionally bound documents, such as a book or telephone directory, without requiring the removal of the document holder from one of the document support stands of the invention described previously.

As shown in FIG. 41, the document holder basically includes the directory cover 302 disclosed in U.S. Pat. No. 3,425,421 and shown in FIG. 4 of that patent, which is modified to include a T-rail 304 mounted on the spine panel 306 of the cover. A wire rod 308 is removably attached to the spine panel 306, and holds a bound book 310 in place between it and the spine. The wire rod 308 is removable so that a different book may be substituted and held by the document holder.

Similarly, as shown in FIG. 42, a book lock binder 312, such as disclosed in U.S. Pat. No. 2,323,123, having a flat bottom plate 314, a pair of upstanding, spaced apart end blocks 316 and a raised bar 318 which is slidably received by the end blocks 316 to secure a book between the bar and the bottom plate 314, may be modified to include a T-rail 320 mounted on the underside of the bottom plate 314. With this modification, the book lock binder of U.S. Pat. No. 2,323,123 may be mounted on one of the document support stands of the present invention, and different books may be substituted on the binder by removing and replacing the bar, without having to remove the binder from the support stand.

It is also envisioned to use the document support stands of the present invention for holding a display cabinet 322 in place on the stand. As shown in FIG. 43, the preferred form of the display cabinet is rectangular, and it includes a front side 324 and a back side 326. A hinged transparent viewing door 328 having a lock or latch 330 is mounted on the front side. The back side is provided with a T-rail 332 so that the display cabinet may be mounted on a document support stand having a cooperating T-slot formed in it, as described in the previous embodiments. The display cabinet 322 may be opened at its door, and a document 334 may be placed in it and secured in the cabinet by locking the door, which document 334 may be viewed through the transparent door 328.

It may be desirable to form the document holder with the mechanism that holds the documents being made removable from the cover or protective jacket of the holder. This is especially desirable with modern D-ring loose-leaf binders, which have their binder mechanisms fastened on the inside back cover near the spine, and which include oversized front covers. In many instances, it would be awkward and unnecessary to support such holders in the open condition on the stand, as such loose-leaf binders require an exorbitant amount of space for their oversized jackets.

Figure 10:
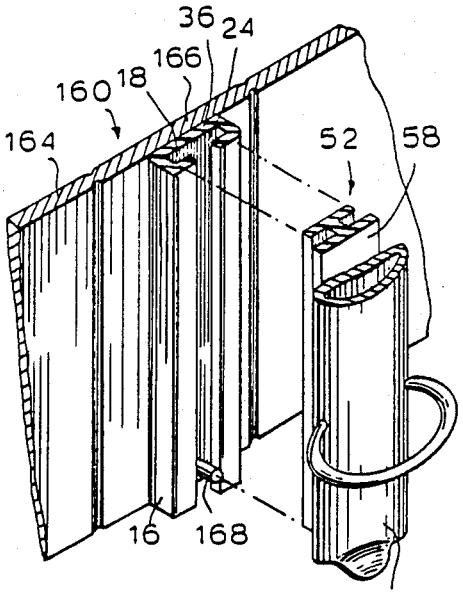
FIG. 10 is a fragmentary perspective view of a loose-leaf binder-type document holder, as an alternative to the form illustrated by FIGS. 2 and 3.

For this reason, a document holder with a document holding mechanism that may be removed and secured to the document support stand may be employed. By way of example, one such document holder, a loose-leaf binder 160, constructed in accordance with the present invention, is shown in FIG. 10.

The loose-leaf binder-type document holder 160 includes a binder mechanism 162, for holding documents, and a protective jacket 164. In the embodiment illustrated, the binder mechanism 162 is positioned at the spine 166 of the jacket 164. However, the same or similar modification would apply to a loose-leaf binder with its mechanism 162 offset from the spine. A C-shaped bracket 16 having the same structure shown in FIG. 3 and described previously defines a T-slot 24, and is mounted on the jacket 164 with its back plate 18 fastened by glue, fasteners or other means to the inside surface of the jacket 164, and positioned at the spine 166. Alternatively, the bracket 16 may be integrally formed in the jacket 164.

A T-rail 52, having the same structure as that described previously in relation to the other forms of document holders, is mounted on the binder mechanism 162, with its back plate 58 abutting against the mechanism and fastened by glue or other means. The T-rail 52 of the binder mechanism 162 is slidably received by the T-slot 24 of the C-bracket 16 through an exposed open end 36 of the bracket.

The C-bracket 16 may include a pin 168 positioned near one of its ends. The pin 168 projects through the narrowed portion 26 of the slot defined by the bracket, and is provided for limiting axial movement of the T-rail 52 within the slot so that the binder mechanism 162 will not inadvertently slide out of the bottom of the jacket 164 when the two are assembled.

The structure of the document holder described above in relation to FIG. 10 allows the user to remove the binder mechanism 162 holding the documents and secure the mechanism to any one of the document support stands 2 previously described, without the need for mounting the jacket on the stand.

The document holder of FIG. 10 may be further modified as shown in FIGS. 20 and 21. As shown in FIG. 21, the back plate 58 of the T-rail 52, which is used for mounting the binder mechanism 162 on the rail, may be extended on one side well beyond the width of the binder mechanism 162. The extended portion 326 of the back plate 58 serves as a handle when removing the T-rail 52 and binder mechanism 162 from the loose-leaf jacket 164 and mounting the T-rail and binder mechanism on the document support stand. The extended portion 326 of the T-rail 52 also helps prevent the pages from pivoting about the binder rings and from interfering with the mounting of the T-rail on the support stand. The handle portion 326 of the T-rail may be formed of a pliant, semi-rigid material which will bend slightly when grasped.

FIG. 20 illustrates the binder mechanism and T-rail described above, mounted on a loose-leaf binder jacket at a point which is offset from the spine 166 of the jacket. In the particular embodiment illustrated, one of the covers of the jacket includes a substantially thickened portion 328 so that a T-slot 330 may be formed directly in the thickened cover. The thickened cover 328 supports the extended handle portion 326 of the T-rail over substantially the full width of the handle portion. Of course, it is envisioned to form the T-slot 330 in a flat backing plate 332, extended as described above with respect to portion 328 to form a handle, on which the binder mechanism 162 is mounted, as shown in FIG. 23. This allows the binder mechanism 162 and backing plate 332 to be removed from the loose-leaf jacket and to be positioned on a document support stand having a T- C rail mounted on it, such as the type illustrated by FIG. 22.

Also, it is envisioned to be within the scope of the present invention to form a T-slot 334 in a thickened portion 336 of the back or front cover of a conventionally bound document holder 338, such as a looseleaf binder, spiral notebook, memo pad or book, such as illustrated by FIG. 24 of the drawings. The T-slot 334 is preferably situated on the cover such that it is offset from the spine 340 of the document holder. With this modification illustrated by FIG. 24, as described above, a conventional document holder may be supported by any one of the document support stands described previously but modified by replacing the slot defining means with a T-rail or rail member situated on the viewing side of the stand.

FIGS. 11 through 13 illustrate the versatility of the document support stands and document holders, with their interlocking T-slots and T-rails, and the applicability of the concepts of the present invention to other forms of document holders, constructed in accordance with the present invention.

For example, FIG. 11 shows a clipboard-type document holder, having a board-like backing 170 on which is mounted a clip fastener or a pair of clip fasteners 172. The fasteners 172 are provided to secure a document 174 to the clipboard-type holder.

The holder includes a T-rail 52, such as previously described, mounted on its back. The T-rail 52 interfits with the T-slots 24, 138, 140 formed in the document support stands of the invention so that the clipboard-type holder may be supported by the stands in a variety of positions.

FIG. 12 shows a spiral-bound document holder having a spiral binding mechanism 180 interfitted with a T-rail member 52, as described previously. Like the clipboard-type holder of FIG. 11, the spiral bound document holder may be removably secured to any one of the document support stands previously described.

FIG. 13 shows an L-shaped document holder having an easel back 182 and support ledge 184 joined to the easel back 182. The document holder includes a T-rail 52 mounted on the rear of the easel back 182 so that the L-shaped holder may be mounted on the document support stands described herein.

Because the document support stands and document holders of the present invention employ conforming T-slots and T-rails, the user is provided with the free interexchange of holders and stands, so that he may select any combination of stand and holder to fit his needs.

It is also envisioned that other types of interlocking means may be employed, rather than the T-slot 24 and T-rail 52 of the embodiments described. As such, different species of document support systems may evolve, with non-compatible interlocking means between species. So that document holders of one species may be supported on a document support stand of another species, and vice versa, an adapter plate may be employed.

Figure 14:
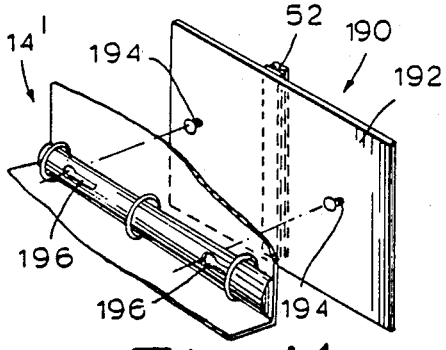
FIG. 14 is a perspective view of an adapter plate, constructed in accordance with the present invention, and a loose-leaf binder, illustrating its attachment to the adapter plate.

An example of such an adapter plate 190 is shown in FIG. 14. The adapter plate 190 includes a flat, plate-like body 192 having front and rear sides. Different forms of interlocking means are provided on the front and rear sides.

For example, the front side of the body 192 may have stud fasteners 194 with oversized heads mounted to protrude from the surface of the body. The stud fasteners 194 are adapted to be received by keyhole slots 196 formed in the spine or binder mechanism of a loose-leaf type document holder 14'.

A T-rail 52 is mounted on the rear side of the adapter plate 190. The T-rail 52 has the same structure as in the embodiments previously described and conforms to the T-slot 24 formed in the document support stands also previously described.

Thus, the adapter plate 190 may be used to conform the loose-leaf binder holder 14' of one type of document support system to the document support system described herein, with its interlocking T-rail 52 and T-slot 24 configurations.

Figure 25:
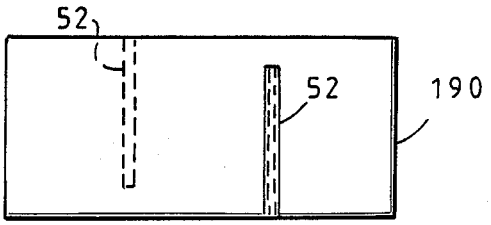
FIG. 25 is a front elevational view of a second form of an adapter plate, constructed in accordance with the present invention.
Figure 27:
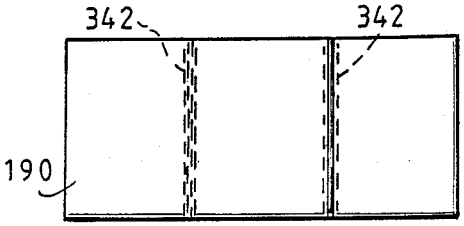
FIG. 27 is a front elevational view of a fourth form of an adapter plate, constructed in accordance with the present invention.
Figure 26:
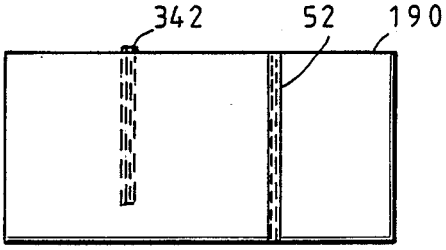
FIG. 26 is a front elevational view of a third form of an adapter plate, constructed in accordance with the present invention.
Figure 29:
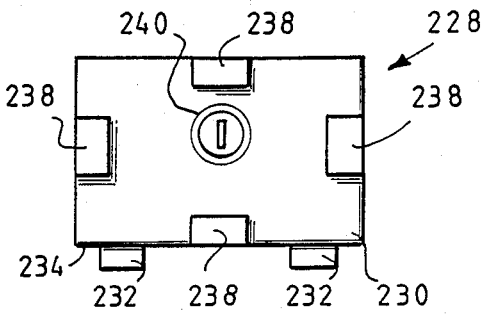
FIG. 29 is a top elevational view of a locking mechanism for use with the document support stand shown in FIG. 28.

The adapter may be in the form of a male-to-male adapter, as illustrated by FIG. 25, with a T-rail 52 mounted on one side of the plate 190, and a T-rail 52 mounted on the opposite side; a female-to-male adapter, as illustrated by FIG. 26, with a T-rail 52 mounted on one side of the plate 190, and a T-slot formed in the plate, or a C-bracket 342 mounted on the plate, on the opposite side; or a female-to-female adapter, with T-slots formed in the plate 190, or C-brackets 342 (defining T-slots) mounted on the plate, on both sides, as illustrated by FIG. 27.

Alternatively, and as illustrated by FIG. 44, a wedge-shaped body 344 which is triangular in cross-section may be substituted for the plate-like body 190 of the adapter. The wedge-shaped body 344 includes a viewing side 346 on which is mounted a T-rail or in which is formed a T-slot 348 (or a C-bracket defining a T-slot), and a mounting side 350 on which is mounted a T-rail 352, C-bracket or in which is formed a T-slot. In this way, a document holder may be mounted on the viewing side 346 of the adapter, and the adapter may be positioned on its mounting side 350 on a document support stand, such as described herein.

The viewing side 346 is preferably disposed at an angle to the mounting side 350. When the adapter 344 is mounted on a document support stand, indicated generally in FIG. 44 as 352, or such as that shown in FIG. 1, the adapter will change the viewing angle of the document holder mounted on its viewing side from that which would have been provided if the document holder were mounted on the document support stand without the adapter.

In most instances, the document support stands of the present invention, in their various described forms, will securely hold the document holder on the stand's viewing surface in no matter what position the stand is placed. This is primarily because the T-rail and C-bracket of the holder and stand, respectively, may be made to frictionally interfit.

It is possible, however, as with the stand shown in FIG. 1, for the T-rail 52 to inadvertently slide out of the open side 36 of the C-bracket 16 if the document stand is positioned with the open side down, and if the T-rail loosely slides in the C-bracket. Accordingly, it may be advantageous to provide the document support stand and holder with a latching or locking mechanism, to ensure that the document holder remains secured to the stand until intentionally removed.

Figure 18:
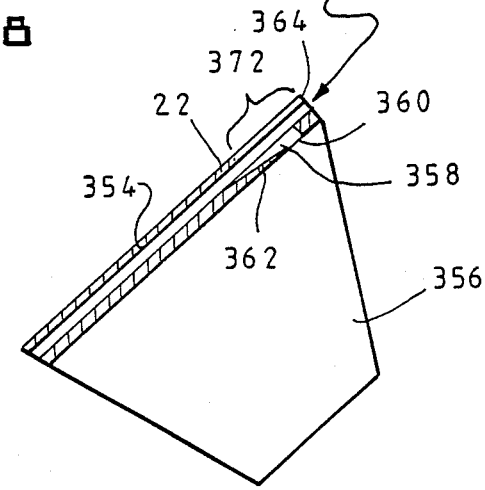
FIG. 18 is a longitudinal cross-sectional view of the document holder and document support stand, modified to include a latching mechanism.

One form of latching mechanism is illustrated by FIG. 18 of the drawings. The C-bracket 354 mounted on the document support stand 356 or, if no C-bracket is used (as in the embodiment shown in FIG. 3B), the inwardly set wall of the viewing side that defines the T-slot, may be formed with a triangular-shaped recess 358, thus defining an abrupt shoulder or stop surface 360, and a gradually inclined surface 362, formed in the bracket or viewing side, as the case may be.

The stop surface 360 is situated more proximate to the open end 364 of the C-bracket or T-slot, and the inclined surface 362 is situated more distal to the open end. The inclined surface 362 and stop surface 360 define the hypotenuse and a side of the triangular-shaped recess 358, respectively.

Similarly, a wedge-shaped member 366 is mounted on the widened portion 56 of the T-rail 52 of the document holder 365. The wedge-shaped member 366 conforms to the shape of the triangular recess, and also includes an inclined surface 368 and a stop surface 370, the stop surface 370 being situated more closely to the end of the Trail 52 than the inclined surface 368.

When the document holder 365 with its T-rail 52 is slid into the open end of the C-bracket 354 or T-slot of the document support stand 356, the wedge member 366 will be received by the recess 358. The T-rail 52 may be formed to be somewhat resilient, and when properly mounted on the C-bracket 354 or T-slot such that its wedge 366 is in alignment with the recess 358, the wedge will be biased toward and resiliently snap into the recess, with the stop surfaces 360, 370 of each facing each other. The document holder is thus locked in position on the viewing side of the document support stand. It cannot inadvertently slide out the open side 364 of the C-bracket or T-slot, because the two stop surfaces will engage each other and prevent this.

To remove the document holder from the support stand, one merely has to lift the end of the T-rail 52 closest to the open end 364 of the C-bracket or T-slot until the stop surface 370 of the wedge member 366 is lifted clear of the stop surface 360 of the C-bracket 354 or T-slot. The document holder may then be removed from the stand.

To ensure that the wedge member 366 may be completely lifted out of the recess 358, the inwardly facing arms 22 of the C-bracket 354, or the area of viewing side defining the narrowed portion 26 of the T-slot, as shown in FIG. 3B, is removed over a portion 372 of its length residing above the recess 358, as shown in FIG. 18. This will prevent the C-bracket or viewing side defining the T-slot from interfering with the upward movement of the T-rail 52 to disengage the wedge member 366 from the recessed portion of the C-bracket 354 or viewing side walls.

Also, the T-rail 52 may be made to be more resilient with the structure shown in FIG. 18. The back plate 58 of the rail is joined to the widened portion 56 of the rail by narrow portion 54. Narrow portion 54 need not extend over the full length of the T-rail 52, as shown. Rather, it may extend over a portion of the rail away from the portion carrying the wedge member 366, so that the back plate 58 and widened portion 56 are unjoined in the vicinity of the wedge member. This structure allows the end of widened portion 56 of the T-rail 52 to be flexed so that the wedge member 366 may be lifted free of the recess 358.

The widened portion 56 may also be made to be slightly longer than the back plate 58 so that it extends slightly beyond the open end 364 of the C-bracket 354 or T-slot. This allows one to easily lift the widened portion 56 with one's finger to disengage the wedge member 366 from the recess 358.

FIG. 19 illustrates another form of a latching mechanism. As shown in FIG. 19, the C-bracket 16 (or the viewing side portions defining the T-slot) may have a series of spaced apart detents or grooves 374 formed in the underside surface of arms 22 or portions 64, 66 which define the narrow portion of the slot. The grooves 374 extend transversely to the longitudinal direction of the T-slot or C-bracket.

The T-rail 52 may include a series of spaced apart protrusions or rounded formations 376 situated along its length on the top side of widened portion 56. Like the grooves 374 formed in the C-bracket, the protrusions 376 extend transversely to the longitudinal axis of the rail. The narrowed portion 54 of the rail 52 may be provided in sections to allow the protrusions 376 to extend across the entire top surface of the widened portion 56.

When the T-rail 52 is inserted into the open side of the C-bracket 16 or T-slot, the protrusions 376 engage the grooves 374. The document holder 378 is thus held in place on the support stand 380 until sufficient force is exerted to disengage the protrusions from the grooves and dismount the holder from the stand. This form of the invention is advantageous in that it allows the document holder to be latched in place at different levels on the viewing side 6 of the stand, as different protrusions 376 may be selected to engage different grooves 374. Of course, it is envisioned to form the T-rail 52 with protrusions 376 on the bottom side of widened portion 56, and to form the grooves 374 in the back plate 18 of C-bracket 16 or the inside back surface of the viewing side defining a T-slot, as in FIG. 3B (if no C-bracket is used), with comparable results. Also, the positions of the protrusions and recesses may be reversed, that is, the recesses 374 may be formed on the T-rail 52, and the protrusions 376 may be formed on the C-bracket 16 or viewing side 6.

Another embodiment of the present invention for securing a document holder, such as a book, loose-leaf binder or the like, to one of the document support stands described previously is illustrated by FIGS. 39 and 40. In this embodiment, a pair of rectangular, box-like sleeves 382*a*, 382*b* are provided. The sleeves 382*a*, 382*b* are open in their interiors, and each includes at least one open side 384. The sleeves 382*a*, 382*b* are dimensioned to be at least slightly larger than the front and back covers or jacket of the document holder so that they can receive the cover or jacket of the holder through their open sides 384.

Mounted on the bottom of each sleeve 382*a*, 382*b* is a T-rail 52, such as described previously with other embodiments. The T-rails 52 allow the sleeves to be mounted on one of the document support stands of the present invention, for example, the type of stand illustrated by FIG. 28.

As shown in FIG. 40, one sleeve 382*a*, is slid into a T-slot 24 of a document support stand (indicated generally by reference numeral 386), and the document holder (shown in FIG. 40 as a looseleaf binder 388) is positioned on the stand with its front cover, for example, placed into the open side 384 of the sleeve. The document holder 388 should be almost fully inserted into the sleeve 382*a* with the spine of the holder being approximately an inch, or less, from the open side 384 of the sleeve. The other sleeve 382*b* is then inserted into the same T-slot 24, with its open side facing the open side of the first sleeve 382*a*, and now the back cover of the document holder is placed into and received by the open side of the second sleeve 382*b*. In this manner, the document holder will be secured to the document support stand.

To lock the document holder to the stand when using the sleeves of FIG. 39 in order to prevent the holder from being removed, a pair of locking mechanisms 228, such as that shown in FIG. 34 and described previously, may be employed. The locking mechanisms are placed on the outside of the sleeves 382*a*, 382*b* so that the sleeves may not slide away from the document holder.

It is also envisioned to form a document support stand with a single slot defining means and which is adapted to hold one or several document holders in a plurality of different positions, all holders being mounted on the stand by using the same slot.

Such a stand 390 is shown in FIG. 46 of the drawings. It basically includes a plate-like member 392 having slot defining means, such as a C-bracket mounted on it at its viewing side, as described previously in relation to the stand shown in FIG. 3A, or having a T-slot 24 formed directly in its viewing side, such as described in relation to the stand shown in FIG. 3B.

The document holder 396 includes a T-rail 398 mounted on it. However, the T-rail 398 differs in construction from the T-rails described previously in relation to the other embodiments of the invention.

As shown in FIG. 47, the holder has a narrowed portion 394 joined to a widened portion 400, but the widened portion 400 of the T-rail 398 has a width and length which are substantially equal to each other and which are equal to or slightly smaller than the widened portion 28 of the T-slot formed in the stand. Similarly, the narrowed portion 394 of the T-rail has a width and length which are substantially equal to each other and which are equal to or slightly smaller than narrowed portion 26 of the T-slot. This configuration of the T-rail will allow the widened portion 400 to be inserted either lengthwise or sidewise into the T-slot 24.

Accordingly, the T-rail 398 may be formed with a square-shaped widened portion 400, as shown in FIG. 47. A document holder having the square-shaped T-rail mounted on it is thus positionable on the viewing side of the stand in four different dispositions, depending on how the T-rail is inserted into the T-slot. Because of the square-shape of the T-rail, the document holder, once mounted on the stand, cannot rotate relative to the stand, and will be maintained in that particular disposition selected at the time it is mounted, until it is removed, turned to a different disposition and remounted on the stand.

Alternatively, the T-rail 398 may be formed with a circular widened portion 402 and a concentrically disposed circular narrowed portion 403, as shown in FIG. 48. Like the square-shaped embodiment described above, the circular widened portion 402 of the T-rail has a diameter which is equal to or slightly less than the width of the widened portion 28 of the T-slot 24 and the circular narrowed portion 403 of the T-rail has a diameter which is equal to or slightly less than the width of the narrowed portion 26 of the T-slot so that the T-rail may be received by the T-slot in any disposition of the T-rail. This allows the T-rail to be rotatable in the T-slot.

A document holder having the circular T-rail mounted on it is thus positionable on the viewing side of the stand in an infinite number of dispositions. When mounted on the stand, the document holder may be rotated to a different viewing disposition, even though it is securely mounted on the stand.

Thus, a stand having a single slot may be used to mount one or more document holders, having a T-rail as described above, which document holders may be positioned in a plurality of viewing dispositions.

The document support stands and document holders of the present invention allow the user to support a document holder on a stand he selects and position the document holder in multiple positions for different reading patterns.

The document support stands may be formed from a plastic or other synthetic material, as well as sheet metal or wood. The T-rails 52 and C-brackets 16 may be inexpensively formed of an extruded plastic material.

As is evident from the structures described and shown in the drawings, the document support stands are mechanically simple, with few components, and easily manufactured, and each is adapted to receive and hold a document holder in a number of viewing dispositions.

Although illustrative embodiments of the present invention have been described herein with reference to the accompanying drawings, it to be understood that the invention is not limited to those precise embodiments, and that various other changes and modifications may be effected therein by one skilled in the art without departing from the scope or spirit of the invention.

What is claimed is:

1. A document support stand for removably mounting a document holder thereon, which comprises:

a main body, the body including a viewing side, a first support side and a second support side, the viewing side having at least first and second edges disposed transversely to each other, the first support side being joined to the viewing side at the first edge thereof, the second support side being joined to the viewing side at the second edge thereof, each of the viewing side and the first and second support sides being substantially planar, the first and second support sides extending angularly from the viewing side on the same side of the plane in which the viewing side resides, the first support side and the viewing side defining therebetween an acute first angle at the first edge, the second support side and the viewing side defining therebetween an acute second angle at the second edge; and means for removably mounting a document holder on the body, the document holder mounting means being situated on the body at the viewing side thereof to allow the document holder to be mounted on the viewing side, the stand being selectively positionable to rest on one of the first support side, thereby supporting a document holder mounted thereon in a first viewing position, and the second support side, thereby supporting a document holder mounted thereon in a second viewing position which is transverse to the first viewing position, the viewing side residing in an x-y coordinate plane which is perpendicular to a z-axis of rotation, the document support stand being adapted to be rotated about the z-axis of rotation so that the viewing side thereof is correspondingly turned within the x-y coordinate plane and adjusted in position within the x-y coordinate plane;

wherein the main body defines a hollow interior space; and which further comprises weighted means disposed in the interior space of the main body, the weighted means being adapted to move within the interior space of the body whenever the document support stand is repositioned from one of the first and second support sides to the other of the first and second support sides so as to help lower the center of gravity of the document support stand.

2. A document support stand as defined by claim 1, wherein the weighted means includes at least one bag-like container of material.

3. A document support stand as defined by claim 1, wherein the main body is fluidtight with respect to its interior space and has formed in a side thereof a sealable access opening, the opening being in communication with the interior space; and wherein the weighted means is in the form of a liquid.

4. A document support stand for removably mounting a document holder thereon, which comprises:

a main body, the main body including a viewing side, and first and second support means for supporting the viewing side in at least two viewing dispositions which are transverse to each other; and means for removably mounting a document holder on the body, the document holder mounting means being situated on the body at the viewing side thereof to allow the document holder to be mounted on the viewing side, the stand being selectively positionable to rest on one of the first support means, thereby supporting a document holder mounted thereon in a first viewing disposition, and the second support means, thereby supporting a document holder mounted thereon in a second viewing disposition which is transverse to the first viewing disposition, the viewing side residing in an x-y coordinate plane which is perpendicular to a z-axis of rotation, the document support stand being adapted to be rotated about the z-axis of rotation so that the viewing side thereof is correspondingly turned within the x-y coordinate plane and adjusted in position within the x-y coordinate plane;

wherein the first support means includes a substantially planar support side of the main body, the support side being joined to the viewing side;

wherein each of the planar support side and viewing side of the main body is hollow and defines an interior space, the interior space of the support side being in communication with the interior space of the viewing side; and wherein the document support stand further includes a moveable ballast, the ballast at least partially filling the interior spaces of the support side and viewing side and being adapted to move from the interior space of one side to the interior space of the other side when the stand is repositioned from one of the first and second viewing dispositions to the other of the first and second viewing dispositions.

5. A document support stand as defined by claim 4, wherein the moveable ballast is a liquid.

6. In combination:

a document holder, and a document support stand for removably mounting the document holder thereon;

the document support stand including a main body, the main body including a viewing side, a first support side and a second support side, the viewing side having at least first and second edges disposed transversely to each other, the first support side being joined to the viewing side at the first edge thereof, the second support side being joined to the viewing side at the second edge thereof, each of the viewing side and the first and second support sides being substantially planar, the first and second support sides extending angularly from the viewing side on the same side of the plane in which the viewing side resides, the first support side and the viewing side defining therebetween an acute first angle at the first edge, the second support side and the viewing side defining therebetween an acute second angle at the second edge; and means for removably mounting the document holder, the document holder mounting means being situated on the body at the viewing side thereof to allow the document holder to be mounted on the viewing side, the stand being selectively positionable to rest on one of the first support side, thereby supporting a document holder mounted thereon in a first viewing position, and the second support side, thereby supporting a document holder mounted thereon in a second viewing position which is transverse to the first viewing position, the viewing side residing in an x-y coordinate plane which is perpendicular to a z-axis of rotation, the document support stand being adapted to be rotated about the z-axis of rotation so that the viewing side thereof is correspondingly turned within the x-y coordinate plane and adjusted in position within the x-y coordinate plane;

the document holder including means for mounting documents, means for supporting the document mounting means, the document mounting means being mounted thereon, and means mounted on the document mounting support means for engageably cooperating with the document holder mounting means of the document support stand wherein the document support stand further comprises means for selectively latching the document holder to the viewing side of the document support stand.

7. A combination as defined by claim 6, wherein the means for removably mounting the document holder includes means defining an elongated slot situated on the viewing side of the body, the slot defining means forming the slot with a substantially "T" shape in cross-section, and with a narrowed portion and a widened portion communicating with the narrowed portion; wherein said means mounted on the document mounting support means of the document holder for engageably cooperating with the document holder mounting means of the document support stand includes a rail member having a widened portion and narrowed portion which respectively cooperate with the widened portion and narrowed portion of the slot defined by the slot defining means, the rail member being slidably received by the slot of the slot defining means; and wherein the latching means includes a portion of the slot defining means in which a recess is formed and a cooperating protruding portion of the rail member, the protruding portion of the rail member being adapted to be received by the recess formed in the slot defining means so as to selectively latch the rail member to the slot defining means to help prevent the rail member from inadvertently sliding longitudinally with respect to the slot defining means.

8. A combination as defined by claim 7, wherein the protruding portion of the rail member includes a wedge-shaped member situated on the widened portion of the rail member; and wherein the recess is triangular-shaped so as to conform to the shape of the wedge-shaped member and so as to be adapted to receive the wedge-shaped member.

9. A combination as defined by claim 7, wherein the rail member is resilient and will cause the protruding portion to be biased toward and be resiliently received by the recess when the protruding portion and recess are in alignment.

10. A combination as defined by claim 8, wherein the slot defining means includes a first stop surface defining a side of the triangular shaped recess, and the wedge-shaped member includes a side which defines a second stop surface, the first and second stop surfaces being situated to engage each other when the wedge-shaped member is received in the recess to prevent the rail member from sliding within the slot.

11. A combination as defined by claim 7, wherein the rail member further includes a back plate mounted on the narrowed portion of the rail member and spaced apart from the widened portion, the back plate and widened portion being unjoined to the narrow portion in the vicinity of the protruding portion of the rail member to provide the widened portion of the rail member with greater flexibility and to facilitate the removal of the protruding portion from the recess.

12. A combination as defined by claim 6, wherein the means for removably mounting the document holder includes means defining an elongated slot situated on the viewing side of the body, the slot defining means forming the slot with a substantially "T" shape in cross-section, and with a narrowed portion and a widened portion communicating with the narrowed portion; wherein said means mounted on the document mounting support means of the document holder for engageably cooperating with the document holder mounting means of the document support stand includes a rail member having a widened portion and narrowed portion which respectively cooperate with the widened portion and narrowed portion of the slot defined by the slot defining means, the rail member being slidably received by the slot of the slot defining means; and wherein the latching means includes a plurality of spaced apart detents formed in one of the slot defining means and the rail member, and a plurality of spaced apart protrusions formed on the other of the slot defining means and the rail member, the protrusions being received by the detents when the rail member is slidably received by the slot of the slot defining means so as to selectively latch the rail member to the slot defining means and to help prevent the rail member from inadvertently sliding longitudinally with respect to the slot defining means.

13. In combination:

a document holder, and a document support stand for removably mounting the document holder thereon;

the document support stand including a planar, plate-like body having a front viewing side and a rear side opposite the front side, means for rotatably supporting the plate-like body and for positioning the body in a selectable angular disposition about a z-axis of rotation, the body being mounted on the body supporting means on the rear side thereof, and means for removably mounting the document holder, the document holder mounting means being situated on the body at the viewing side thereof and substantially at a central portion thereof to allow the document holder to be mounted on the viewing side and to support the document holder at a substantially central portion of the document holder, the document holder mounting means being selectively engageable with the document holder, wherein the body may be rotated on the supporting means to position the viewing side and a document holder mounted thereon in one of a number of selectable viewing positions, the viewing side residing in an x-y coordinate plane which is perpendicular to a z-axis of rotation, the plate-like body being adapted to be rotated about the z-axis of rotation so that the viewing side thereof is correspondingly turned within the x-y coordinate plane and adjusted in position within the x-y coordinate plane;

the document holder including means for mounting documents, means for supporting the document mounting means, the document mounting means being mounted thereon, and means mounted on the document mounting support means for engageably cooperating with the document holder mounting means of the document support stand;

wherein the document support stand further comprises means for selectively latching the document holder to the viewing side of the document support stand.

14. A document support stand as defined by claim 13, wherein the means for removably mounting the document holder includes means defining an elongated slot situated on the viewing side of the body, the slot defining means forming the slot with a substantially "T" shape in cross-section, and with a narrowed portion and a widened portion communicating with the narrowed portion; wherein said means mounted on the document mounting support means of the document holder for engageably cooperating with the document holder mounting means of the document support stand includes a rail member having a widened portion and narrowed portion which respectively cooperate with the widened portion and narrowed portion of the slot defined by the slot defining means, the rail member being slidably received by the slot of the slot defining means; and wherein the latching means includes a portion of the slot defining means in which a recess is formed and a cooperating protruding portion of the rail member, the protruding portion of the rail member being adapted to be received by the recess formed in the slot defining means so as to selectively latch the rail member to the slot defining means to help prevent the rail member from inadvertently sliding longitudinally with respect to the slot defining means.

15. A document support stand as defined by claim 14, wherein the protruding portion of the rail member includes a wedge-shaped member situated on the widened portion of the rail member; and wherein the recess is triangular-shaped so as to conform to the shape of the wedge-shaped member and so as to be adapted to receive the wedge-shaped member.

16. A document support stand as defined by claim 14, wherein the rail member is resilient and will cause the protruding portion to be biased toward and be resiliently received by the recess when the protruding portion and recess are in alignment.

17. A document support stand as defined by claim 15, wherein the slot defining means includes a first stop surface defining a side of the triangular shaped recess, and the wedge-shaped member includes a side which defines a second stop surface, the first and second stop surfaces being situated to engage each other when the wedge-shaped member is received in the recess to prevent the rail member from sliding within the slot.

18. A document support stand as defined by claim 14, wherein the rail member further includes a back plate mounted on the narrowed portion of the rail member and spaced apart from the widened portion, the back plate and widened portion being unjoined to the narrow portion in the vicinity of the protruding portion of the rail member to provide the widened portion of the rail member with greater flexibility and to facilitate the removal of the protruding portion from the recess.

19. A combination as defined by claim 13, wherein the means for removably mounting the document holder includes means defining an elongated slot situated on the viewing side of the body, the slot defining means forming the slot with a substantially "T" shape in cross-section, and with a narrowed portion and a widened portion communicating with the narrowed portion; wherein said means mounted on the document mounting support means of the document holder for engageably cooperating with the document holder mounting means of the document support stand includes a rail member having a widened portion and narrowed portion which respectively cooperate with the widened portion and narrowed portion of the slot defined by the slot defining means, the rail member being slidably received by the slot of the slot defining means; and wherein the latching means includes a plurality of spaced apart detents formed in one of the slot defining means and the rail member, and a plurality of spaced apart protrusions formed on the other of the slot defining means and the rail member, the protrusions being received by the detents when the rail member is slidably received by the slot of the slot defining means so as to selectively latch the rail member to the slot defining means and to help prevent the rail member from inadvertently sliding longitudinally with respect to the slot defining means

20. In combination:

a document holder, and a document support stand for removably mounting the document holder thereon;

the document support stand including a main body, the main body including a viewing side, a first support side and a second support side, the viewing side having at least first and second edges disposed transversely to each other, the first support side being joined to the viewing side at the first edge thereof, the second support side being joined to the viewing side at the second edge thereof, each of the viewing side and the first and second support sides being substantially planar, the first and second support sides extending angularly from the viewing side on the same side of the plane in which the viewing side resides, the first support side and the viewing side defining therebetween an acute first angle at the first edge, the second support side and the viewing side defining therebetween an acute second angle at the second edge; and means for removably mounting the document holder, the document holder mounting means being situated on the body at the viewing side thereof to allow the document holder to be mounted on the viewing side, the stand being selectively positionable to rest on one of the first support side, thereby supporting a document holder mounted thereon in a first viewing position, and the second support side, thereby supporting a document holder mounted thereon in a second viewing position which is transverse to the first viewing position, the viewing side residing in an x-y coordinate plane which is perpendicular to a z-axis of rotation, the document support stand being adapted to be rotated about the z-axis of rotation so that the viewing side thereof is correspondingly turned within the x-y coordinate plane and adjusted in position within the x-y coordinate plane;

the document holder including means for mounting documents, means for supporting the document mounting means, and cooperating first and second means for removably mounting the document mounting means to the supporting means, the first means being mounted on the supporting means, the second means being mounted on the document mounting means, the second means being cooperatingly engageable with the document holder mounting means of the document support stand to allow the document mounting means to be removed from the supporting means of the document holder and mounted on the viewing side of the document support stand;

wherein the means for removably mounting the document holder includes means defining an elongated slot situated on the viewing side of the body, the slot defining means forming the slot with a substantially "T" shape in cross-section, and with a narrowed portion and a widened portion communicating with the narrowed portion; and wherein said second means for removably mounting the document mounting means to the supporting means includes a rail member having a widened portion and a narrowed portion which respectively cooperate with the widened portion and narrowed portion of the slot defined by the slot defining means, the rail member being slidably received by the slot of the slot defining means, the rail member further including a back plate mounted on the narrowed portion of the rail member and spaced apart from the widened portion, the back plate extending beyond the width of the document mounting means at least on one side thereof and defining a handle to facilitate removal of the rail member and document mounting means from the supporting means of the document holder and for mounting the rail member and document mounting means on the document support stand.

21. In combination:

a document holder, and a document support stand for removably mounting the document holder thereon;

the document support stand including a planar, plate-like body having a front viewing side and a rear side opposite the front side, means for rotatably supporting the plate-like body and for positioning the body in a selectable angular disposition about a z-axis of rotation, the body being mounted on the body supporting means on the rear side thereof, and means for removably mounting the document holder, the document holder mounting means being situated on the body at the viewing side thereof and substantially at a central portion thereof to allow the document holder to be mounted on the viewing side and to support the document holder at a substantially central portion of the document holder, the document holder mounting means being selectively engageable with the document holder, wherein the body may be rotated on the supporting means to position the viewing side and a document holder mounted thereon in one of a number of selectable viewing positions, the viewing side residing in an x-y coordinate plane which is perpendicular to a z-axis of rotation, the plate-like body being adapted to be rotated about the z-axis of rotation so that the viewing side thereof is correspondingly turned within the x-y coordinate plane and adjusted in position within the x-y coordinate plane;

the document holder including means for mounting documents, means for supporting the document mounting means, and cooperating first and second means for removably mounting the document mounting means to the supporting means, the first means being mounted on the supporting means, the second means being mounted on the document mounting means, the second means being cooperatingly engageable with the document holder mounting means of the document support stand to allow the document mounting means to be removed from the supporting means of the document holder and mounted on the viewing side of the document support stand;

wherein the means for removably mounting the document holder includes means defining an elongated slot situated on the viewing side of the body, the slot defining means forming the slot with a substantially "T" shape in cross-section, and with a narrowed portion and a widened portion communicating with the narrowed portion; and wherein said second means for removably mounting the document mounting means to the supporting means includes a rail member having a widened portion and a narrowed portion which respectively cooperate with the widened portion and narrowed portion of the slot defined by the slot defining means, the rail member being slidably received by the slot of the slot defining means, the rail member further including a back plate mounted on the narrowed portion of the rail member and spaced apart from the widened portion, the back plate extending beyond the width of the document mounting means at least on one side thereof and defining a handle to facilitate removal of the rail member and document mounting means from the supporting means of the document holder and for mounting the rail member and document mounting means on the document support stand.

22. An adapter for coupling a document holder to a document support stand, the adapter comprising:

first means for removably mounting a document holder to the adapter;

second means for removably mounting the adapter to the document support stand; and means for supporting the first and second mounting means;

wherein the means for supporting the first and second mounting means includes a flat plate-like body having front and rear sides, the first means being mounted on the front side thereof, and the second means being mounted on the rear side thereof;

and wherein one of the first and second means includes means defining an elongated slot, the slot defining means forming the slot with a substantially "T" shape in cross section, and with a narrowed portion and a widened portion communicating with the narrowed portion; and wherein the other of the first and second means includes a rail member having a widened portion and a narrowed portion.

23. An adapter for coupling a document holder to a document support stand, the adapter comprising:

first means for removably mounting a document holder to the adapter;

second means for removably mounting the adapter to the document support stand; and means for supporting the first and second mounting means;

wherein the means for supporting the first and second mounting means including a flat plate-like body having front and rear sides, the first means being mounted on the front side thereof, and the second means being mounted on the rear side thereof;

and wherein each of the first and second means includes means defining an elongated slot, the slot defining means forming the slot with a substantially "T" shape in cross-section, and with a narrowed portion and a widened portion communicating with the narrowed portion.

24. An adapter for coupling a document holder to a document support stand, the adapter comprising:

first means for removably mounting a document holder to the adapter;

second means for removably mounting the adapter to the document support stand; and means for supporting the first and second mounting means;

wherein the means for supporting the first and second mounting means includes a flat plate-like body having front and rear sides, the first means being mounted on the front side thereof, and the second means being mounted on the rear side thereof;

and wherein each of the first and second means includes a rail member having a widened portion and a narrowed portion.

25. An adapter for coupling a document holder to a document support stand, the adapter comprising:

first means for removably mounting a document holder to the adapter;

second means for removably mounting the adapter to the document support stand; and means for supporting the first and second mounting means;

wherein the means for supporting the first and second mounting means includes a wedge-shaped body which is triangular in cross-section, the body including a viewing side on which the first means is situated, and a mounting side on which the second means is situated.

26. A document support stand for removably mounting at least one document holder thereon, which comprises:

a main body, the main body including a viewing side; and first means for mounting a document holder in a first disposition on the viewing side of the body, and second means for mounting a document holder in a second disposition on the viewing side of the body, the first disposition effected by the first mounting means being different from the second disposition effected by the second mounting means, the first and second mounting means being situated on the viewing side of the body, wherein a document holder is selectively engageable with the first and second mounting means and mountable on the viewing side of the document support stand in the first and second different dispositions;

wherein the first mounting means includes first means defining a first elongated slot, and the second mounting means includes second means defining a second elongated slot, the first and second slot defining means being situated on the viewing side of the body;

wherein the viewing side has formed therein a major enlargement, the major enlargement being in communication with the first and second slots, the major enlargement defining an access opening for providing access to the first and second elongated slots for mounting a document holder to the stand.

27. A document support stand as defined by claim 26, which further comprises locking means for preventing the removal of a document holder mounted on the viewing side of the stand, the locking means including a block member dimensioned to conform to the shape of the major enlargement so as to be adapted to be received by the major enlargement, the block member substantially preventing communication between the access opening defined by the major enlargement and the first and second elongated slots when the block member is received by the major enlargement.

28. A document support stand as defined by claim 27, wherein the block member includes a portion thereof which extends from a side thereof, the extending portion of the block being received by a third slot formed in the main body of the stand.

29. A document support stand as defined by claim 27, wherein the block member includes a top surface, and first and second raised portions mounted on the top surface of the block, the first and second portions being situated on the block so as to be in alignment with the first and second elongated slots, respectively, when the block is mounted in the major enlargement.

30. A document support stand as defined by claim 27, wherein the locking means further includes a key lock assembly mounted on the block to prevent the removal of the block from the stand, the key lock assembly having a member which is selectively engageable with a portion of the stand.

31. A document support stand for removably mounting at least one document holder thereon, which comprises:

a main body, the main body including a viewing side; and first means for mounting a document holder in a first disposition on the viewing side of the body, and second means for mounting a document holder in a second disposition on the viewing side of the body, the first disposition effected by the first mounting means being different from the second disposition effected by the second mounting means, the first and second mounting means being situated on the viewing side of the body, wherein a document holder is selectively engageable with the first and second mounting means and mountable on the viewing side of the document support stand in the first and second different dispositions;

wherein the first mounting means includes first means defining a first elongated slot, and the second mounting means includes second means defining a second elongated slot, the first and second slot defining means being situated on the viewing side of the body;

the document support stand further comprising a spacer member, the spacer member being adapted to be received by at least one of the first and second elongated slots to prevent the document holder from moving on the viewing side of the stand when the document holder is mounted thereon.

32. A document support stand as defined by claim 31, wherein the spacer member includes an extendible pin mounted thereon, the pin being adapted to selectively engage one of a plurality of spaced apart openings formed in at least one of the first and second slot defining means.

33. In combination:

a document holder, and a document support stand for removably mounting the document holder thereon;

the document support stand including a main body, the main body including a viewing side, a first support side and a second support side, the viewing side having at least first and second edges disposed transversely to each other, the first support side being joined to the viewing side at the first edge thereof, the second support side being joined to the viewing side at the second edge thereof, each of the viewing side and the first and second support sides being substantially planar, the first and second support sides extending angularly from the viewing side on the same side of the plane in which the viewing side resides, the first support side and the viewing side defining therebetween an acute first angle at the first edge, the second support side and the viewing side defining therebetween an acute second angle at the second edge; and means for removably mounting the document holder, the document holder mounting means being situated on the body at the viewing side thereof to allow the document holder to be mounted on the viewing side, the stand being selectively positionable to rest on one of the first support side, thereby supporting a document holder mounted thereon in a first viewing position, and the second support side, thereby supporting a document holder mounted thereon in a second viewing position which is transverse to the first viewing position, the viewing side residing in an x-y coordinate plane which is perpendicular to a z-axis of rotation, the document support stand being adapted to be rotated about the z-axis of rotation so that the viewing side thereof is correspondingly turned within the x-y coordinate plane and adjusted in position within the x-y coordinate plane;

the document holder including means for mounting documents, means for supporting the document mounting means, the document mounting means being mounted thereon, and means mounted on the document mounting support means for engageably cooperating with the document holder mounting means of the document support stand;

the combination further comprising a rotatable turntable support, the rotatable turntable support including first means for removably mounting a document holder to the rotatable turntable support, and second means for removably mounting the rotatable turntable support to the document support stand.

34. A combination as defined by claim 33, wherein the rotatable turntable support further includes a plate-like body having a top and bottom surface, a turntable assembly having a top portion and a bottom portion, the top portion being mounted on the bottom surface of the body and being adapted to rotate with respect to the bottom portion, the first means being situated on the top surface of the body, and the second means being situated on the bottom portion of the turntable assembly.

35. A combination as defined by claim 34, wherein the first means includes means defining an elongated slot, the slot defining means forming the slot with a substantially "T" shape in cross-section, and with a narrowed portion and a widened portion communicating with the narrowed portion; and wherein the second means includes a rail member having a widened portion and a narrow portion.

36. A combination as defined by claim 33, wherein the rotatable turntable stand further includes a detent stop plate interposed between the plate like body and the turntable assembly, the stop plate including a lateral edge having a plurality of recesses formed therein; and wherein the combination further comprises a pin block, the pin block being adapted to be mounted on the document support stand and selectively positionable adjacent to the rotatable turntable stand, the pin block having a pin member extending therefrom which is engageable with one of the recesses formed in the lateral edge of the stop plate to selectively prevent the rotatable turntable stand from rotating with respect to the document support stand.

37. In combination:

a document holder, and a document support stand for removably mounting the document holder thereon;

the document support stand including a planar, plate-like body having a front viewing side and a rear side opposite the front side, means for rotatably supporting the plate-like body and for positioning the body in a selectable angular disposition about a z-axis of rotation, the body being mounted on the body supporting means on the rear side thereof, and means for removably mounting the document holder, the document holder mounting means being situated on the body at the viewing side thereof and substantially at a central portion thereof to allow the document holder to be mounted on the viewing side and to support the document holder at a substantially central portion of the document holder, the document holder mounting means being selectively engageable with the document holder, wherein the body may be rotated on the supporting means to position the viewing side and a document holder mounted thereon in one of a number of selectable viewing positions, the viewing side residing in an x-y coordinate plane which is perpendicular to a z-axis of rotation, the plate-like body being adapted to be rotated about the z-axis of rotation so that the viewing side thereof is correspondingly turned within the x-y coordinate plane and adjusted in position within the x-y coordinate plane;

the document holder including means for mounting documents, means for supporting the document mounting means, the document mounting means being mounted thereon, and means mounted on the document mounting support means for engageably cooperating with the document holder mounting means of the document support stand;

the combination further comprising a rotatable turntable support, the rotatable turntable support including first means for removably mounting a document holder to the rotatable turntable support, and second means for removably mounting the rotatable turntable support to the document support stand.

38. A combination as defined by claim 37, wherein the rotatable turntable support further includes a plate-like body having a top and bottom surface, a turntable assembly having a top portion and a bottom portion, the top portion being mounted on the bottom surface of the body and being adapted to rotate with respect to the bottom portion, the first means being situated on the top surface of the body, and the second means being situated on the bottom portion of the turntable assembly.

39. A combination as defined by claim 38, wherein the first means includes means defining an elongated slot, the slot defining means forming the slot with a substantially "T" shape in cross-section, and with a narrowed portion and a widened portion communicating with the narrowed portion; and wherein the second means includes a rail member having a widened portion and a narrow portion.

40. A combination as defined by claim 37, wherein the rotatable turntable stand further includes a detent stop plate interposed between the plate like body and the turntable assembly, the stop plate including a lateral edge having a plurality of recesses formed therein; and wherein the combination further comprises a pin block, the pin block being adapted to be mounted on the document support stand and selectively positionable adjacent to the rotatable turntable stand, the pin block having a pin member extending therefrom which is engageable with one of the recesses formed in the lateral edge of the stop plate to selectively prevent the rotatable turntable stand from rotating with respect to the document support stand.

41. In combination:

a document holder, and a document support stand for removably mounting the document holder thereon;

the document support stand including a main body, the main body including a viewing side, a first support side and a second support side, the viewing side having at least first and second edges disposed transversely to each other, the first support side being joined to the viewing side at the first edge thereof, the second support side being joined to the viewing side at the second edge thereof, each of the viewing side and the first and second support sides being substantially planar, the first and second support sides extending angularly from the viewing side on the same side of the plane in which the viewing side resides, the first support side and the viewing side defining therebetween an acute first angle at the first edge, the second support side and the viewing side defining therebetween an acute second angle at the second edge; and means for removably mounting the document holder, the document holder mounting means being situated on the body at the viewing side thereof to allow the document holder to be mounted on the viewing side, the stand being selectively positionable to rest on one of the first support side, thereby supporting a document holder mounted thereon in a first viewing position, and the second support side, thereby supporting a document holder mounted thereon in a second viewing position which is transverse to the first viewing position, the viewing side residing in an x-y coordinate plane which is perpendicular to a z-axis of rotation, the document support stand being adapted to be rotated about the z-axis of rotation so that the viewing side thereof is correspondingly turned within the x-y coordinate plane and adjusted in position within the x-y coordinate plane;

the document holder including means for mounting documents, means for supporting the document mounting means, the document mounting means being mounted thereon, and means mounted on the document mounting support means for engageably cooperating with the document holder mounting means of the document support stand;

wherein the document holder mounting means of the document support stand includes a rail member mounted on the viewing side thereof, the rail member having a widened portion and a narrowed portion joined to the widened portion;

and wherein the document holder includes a cover, and wherein a slot is formed in the cover, the slot having a T-shape in cross-section and being defined with a narrowed portion and a widened portion which respectively cooperate with the narrowed portion and widened portion of the rail member so that the rail member may be slidably received by the slot of the document holder to mount the document holder on the document support stand.

42. In combination:

a document support stand for removably mounting at least one document holder thereon, and a rotatable turntable support adapted to be mounted on the document support stand;

the document support stand including a main body, the main body including a viewing side, and first means for mounting a document holder in a first disposition on the viewing side of the body, and second means for mounting a document holder in a second disposition on the viewing side of the body, the first disposition effected by the first mounting means being different from the second disposition effected by the second mounting means, the first and second mounting means being situated on the viewing side of the body, wherein a document holder is selectively engageable with the first and second mounting means and mountable on the viewing side of the document support stand in the first and second different dispositions;

the rotatable turntable support including first means for removably mounting a document holder to the rotatable turntable support, and second means for removably mounting the rotatable turntable support to the document support stand, the second means of the rotatable turntable support being engagable with at least one of the first and second mounting means of the document support stand to allow the turntable support to be mounted on the document support stand.

43. In combination:

a document holder, and a document support stand for removably mounting the document holder thereon;

the document support stand including a main body, the main body including a viewing side, a first support side and a second support side, the viewing side having at least first and second edges disposed transversely to each other, the first support side being joined to the viewing side at the first edge thereof, the second support side being joined to the viewing side at the second edge thereof, each of the viewing side and the first and second support sides being substantially planar, the first and second support sides extending angularly from the viewing side on the same side of the plane in which the viewing side resides, the first support side and the viewing side defining therebetween an acute first angle at the first edge, the second support side and the viewing side defining therebetween an acute second angle at the second edge; and means for removably mounting the document holder, the document holder mounting means being situated on the body at the viewing side thereof to allow the document holder to be mounted on the viewing side, the stand being selectively positionable to rest on one of the first support side, thereby supporting a document holder mounted thereon in a first viewing position, and the second support side, thereby supporting a document holder mounted thereon in a second viewing position which is transverse to the first viewing position, the viewing side residing in an x-y coordinate plane which is perpendicular to a z-axis of rotation, the document support stand being adapted to be rotated about the z-axis of rotation so that the viewing side thereof is correspondingly turned within the x-y coordinate plane and adjusted in position within the x-y coordinate plane;

the document holder including means for mounting documents, means for supporting the document mounting means, the document mounting means being mounted thereon, and means mounted on the document mounting support means for engageably cooperating with the document holder mounting means of the document support stand;

wherein one of the document holder and document support stand further includes means for selectively locking the document holder to the document support stand, the locking means including a lock assembly mounted on said one of the document holder and the document support stand and having a selectively extendible pin, the pin being adapted to selectively engage an opening formed in the other of the document holder and the document support stand to prevent the document holder from being removed from the stand when mounted thereon.

44. In combination:

a document holder, and a document support stand for removably mounting the document holder thereon;

the document support stand including a planar, plate-like body having a front viewing side and a rear side opposite the front side, means for rotatably supporting the plate-like body and for positioning the body in a selectable angular disposition about a z-axis of rotation, the body being mounted on the body supporting means on the rear side thereof, and means for removably mounting the document holder, the document holder mounting means being situated on the body at the viewing side thereof and substantially at a central portion thereof to allow the document holder to be mounted on the viewing side and to support the document holder at a substantially central portion of the document holder, the document holder mounting means being selectively engageable with the document holder, wherein the body may be rotated on the supporting means to position the viewing side and a document holder mounted thereon in one of a number of selectable viewing positions, the viewing side residing in an x-y coordinate plane which is perpendicular to a z-axis of rotation, the plate-like body being adapted to be rotated about the z-axis of rotation so that the viewing side thereof is correspondingly turned within the x-y coordinate plane and adjusted in position within the x-y coordinate plane;

the document holder including means for mounting documents, means for supporting the document mounting means, the document mounting means being mounted thereon, and means mounted on the document mounting support means for engageably cooperating with the document holder mounting means of the document support stand;

wherein one of the document holder and document support stand further includes means for selectively locking the document holder to the document support stand, the locking means including a lock assembly mounted on said one of the document holder and the document support stand and having a selectively extendible pin, the pin being adapted to selectively engage an opening formed in the other of the document holder and the document support stand to prevent the document holder from being removed from the stand when mounted thereon.

45. In combination:

at least one document holder, and a document support stand for removably mounting the document holder thereon;

the document support stand including a main body, the main body including a viewing side, and first means for mounting the document holder in a first disposition on the viewing side of the body, and second means for mounting the document holder in a second disposition on the viewing side of the body, the first disposition effected by the first mounting means being different from the second disposition effected by the second mounting means, the first and second mounting means being situated on the viewing side of the body, wherein the document holder is selectively engageable with the first and second mounting means and mountable on the viewing side of the document support stand in the first and second different dispositions;

the document holder including means for mounting documents, means for supporting the document mounting means, the document mounting means being mounted thereon, and means mounted on the document mounting support means for engageably cooperating with the document holder mounting means of the document support stand;

wherein one of the document holder and document support stand further includes means for selectively locking the document holder to the document support stand, the locking means including a lock assembly mounted on said one of the document holder and the document support stand and having a selectively extendible pin, the pin being adapted to selectively engage an opening formed in the other of the document holder and the document support stand to prevent the document holder from being removed from the stand when mounted thereon.

46. In combination:

a document holder, and a document support stand for removably mounting the document holder thereon;

the document support stand including a main body, the main body having a viewing side, and means for removably mounting the document holder, the document holder mounting means including means defining an elongated slot situated on the viewing side of the body, the slot defining means forming the slot with a substantially "T" shape in cross-section, and with a narrowed portion and a widened portion communicating with the narrowed portion;

the document holder including means for mounting documents, means supporting the document mounting means, the document mounting means being mounted thereon, and means mounted on the document mounting support means for engageably cooperating with the document holder mounting means of the document support stand;

wherein said means mounted on the document mounting support means of the document holder for engageably cooperating with the document holder mounting means of the document support stand includes a rail member having a widened portion and a narrowed portion which respectively cooperate with the widened and narrowed portion of the slot defined by the slot defining means, the rail member being slidably received by the slot of the slot defining means;

wherein the widened portion of the rail member has a width and length which are substantially equal to each other so as to allow the rail member to be received by the slot when the rail member is in at least two different dispositions with respect to the slot.

47. A combination as defined by claim 46, wherein the widened portion of the rail member has a square shape.

48. A combination as defined by claim 46, wherein the widened portion of the rail member has a circular shape.

49. In combination:

a document holder, a document support stand for removably mounting the document holder thereon, and means for selectively locking the document holder to the stand;

the document support stand including a main body, the main body having a viewing side, and means for mounting a document holder on the viewing side of the body, the document holder mounting means including means defining an elongated slot situated on the viewing side of the body for mounting the document holder on the viewing side;

the document holder including a looseleaf ring binder mechanism having a plurality of rings adapted to open and close, and having a reciprocatingly slidable actuator mounted thereon to effect the opening and closing of the rings, means for supporting the binder mechanism, the binder mechanism being mounted on the supporting means, and means mounted on the supporting means for engageably cooperating with the document holder mounting means of the document support stand to allow the document holder to be mounted on the document support stand;

said means for selectively locking the document holder to the stand including means engageable with the document holder mounting means of the document support stand for mounting the locking means on the document support stand, a selectively extendible pin which is adapted to engage one of a plurality of openings formed in the document support stand, the locking means being adapted to be mounted on the document support stand and positioned thereon to abut against the reciprocatingly slidable actuator of the document holder thereby preventing the rings of the holder from opening.

50. In combination:

a document support stand for removably mounting a document holder thereon, and a rotatable turntable support adapted to be mounted on the document support stand;

the document support stand including a main body, the main body having a viewing side, and means for mounting a document holder on the viewing side of the body, the document holder mounting means including means defining an elongated slot situated on the viewing side of the body for mounting the document holder on the viewing side;

the rotatable turntable support including first means for removably mounting a document holder to the rotatable turntable support, and second means for removably mounting the rotatable turntable support to the document support stand, the second means of the rotatable turntable support being engageable with the document holder mounting means of the document support stand to allow the turntable support to be mounted on the document support stand.

* * * * *